US010761473B2

(12) United States Patent
Yamagishi et al.

(10) Patent No.: US 10,761,473 B2
(45) Date of Patent: Sep. 1, 2020

(54) DEVELOPING DEVICE CAPABLE OF SUPPRESSING THE PASSING OF A RELATIVELY LARGE AMOUNT OF DEVELOPER AND IMAGE FORMING APPARATUS THEREWITH

(71) Applicant: FUJI XEROX CO., LTD., Tokyo (JP)

(72) Inventors: Kazunari Yamagishi, Kanagawa (JP); Takafumi Wakai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/285,236

(22) Filed: Feb. 26, 2019

(65) Prior Publication Data

US 2020/0096933 A1 Mar. 26, 2020

(30) Foreign Application Priority Data

Sep. 26, 2018 (JP) ..... 2018-180689

(51) Int. Cl.
*G03G 15/09* (2006.01)
*G03G 21/16* (2006.01)
*G03G 21/20* (2006.01)

(52) U.S. Cl.
CPC ..... *G03G 21/1647* (2013.01); *G03G 15/0942* (2013.01); *G03G 21/1676* (2013.01); *G03G 21/206* (2013.01)

(58) Field of Classification Search
CPC ..... G03G 21/1647; G03G 21/1676; G03G 15/0898; G03G 15/0942; G03G 21/1832; G03G 2221/1648; G03G 21/206; G03G 15/0813; G03G 15/0822; G03G 2221/0094; G03G 15/0806
See application file for complete search history.

(56) References Cited

U.S. PATENT DOCUMENTS 8,831,465 B2 * 9/2014 Yamane ..... G03G 15/0898 399/92
2010/0296834 A1 * 11/2010 Omori ..... G03G 15/0898 399/99
2012/0251155 A1 * 10/2012 Ishikawa ..... G03G 15/0806 399/92

FOREIGN PATENT DOCUMENTS

JP 08-190265 7/1996
JP 09-054494 2/1997
JP 09-160459 6/1997
JP 3467943 11/2003
(Continued)

*Primary Examiner* — Walter L Lindsay, Jr.
*Assistant Examiner* — Laura Roth
(74) *Attorney, Agent, or Firm* — JCIPRNET

(57) ABSTRACT

A developing device includes a housing, a developer holding device, and a directing device. The housing includes a container portion containing developer and has a developing opening. The developing device has a through portion disposed at a portion of the housing including a downstream edge portion at a downstream portion of the developing opening in a direction in which the developer holding device is rotated. The through portion has an inlet, an outlet, and a passage that connects the inlet and the outlet to each other so as to allow part of an airflow generated by rotation of the developer holding device to be introduced thereinto and flow therethrough. The directing device extends from a portion of the housing opposite to the developing opening with the inlet of the through portion interposed therebetween toward the developer holding device so as to direct the part of the airflow toward the inlet.

11 Claims, 18 Drawing Sheets

( Sb1<Sb2<Sa2 )

(56) References Cited

FOREIGN PATENT DOCUMENTS

| | | | | |
|---|---|---|---|---|
| JP | 2013171136 A | * | 9/2013 | ..... G03G 21/206 |
| JP | 2015-079134 | | 4/2015 | |

* cited by examiner

DEVELOPING DEVICE CAPABLE OF SUPPRESSING THE PASSING OF A RELATIVELY LARGE AMOUNT OF DEVELOPER AND IMAGE FORMING APPARATUS THEREWITH

CROSS-REFERENCE TO RELATED APPLICATIONS

This application is based on and claims priority under 35 USC 119 from Japanese Patent Application No. 2018-180689 filed Sep. 26, 2018.

BACKGROUND

(i) Technical Field

The present disclosure relates to a developing device and an image forming apparatus.

(ii) Related Art

Examples of known related-art techniques such as developing devices and image forming apparatuses that suppress the occurrences of problems caused by flying toner (toner cloud) include the following.

For example, a developing device is described in Japanese Unexamined Patent Application Publication No. 9-54494. This developing device includes a sealing device that seals developer dropping from a developing roller. The sealing device includes a sealing member that is disposed below the developing roller and extends along the entirety of the developing roller in the axial direction. When the developing roller is at a developing position, the distance between the sealing member and the surface of a photoconductor is uniform.

Also, an image forming apparatus is described in Japanese Unexamined Patent Application Publication No. 8-190265. This image forming apparatus includes a photoconductor drum, a developing roller, and a transfer roller. The developing roller is rotated such that a portion of the developing roller closest to the photoconductor drum is moved in the same direction as that of the photoconductor drum so as to form a toner image. The transfer roller transfers the toner image on the photoconductor drum to a transfer receiving member. The image forming apparatus has an opening that is elongated in the axial direction of the photoconductor drum and disposed between the developing roller and the transfer roller so as to be close to the photoconductor drum and face upward. The image forming apparatus includes a toner cloud discharge duct that extends downward or obliquely downward. The width of the opening of the toner cloud discharge duct in the rotating direction of the photoconductor drum is larger than the distance between an end portion of the opening near the transfer roller and the surface of the photoconductor drum.

Also, an image forming unit is described in Japanese Unexamined Patent Application Publication No. 2015-79134. This image forming unit includes a developing member, a housing member, and a guide member. The developing member develops an electrostatic latent image formed on an image holding body being rotated. The housing member has an end portion that faces an image holding body at a portion downstream of the developing member in a moving direction of the image holding body and houses the developing member. The guide member faces the end portion at a portion downstream of the housing member in the moving direction of the image holding body and guides a recording medium toward the image holding body. A channel is formed between the end portion of the housing member and the guide member. The channel directs an airflow generated by rotation of the image holding body in a direction separating from the image holding body.

Also, a toner cloud collecting device is described in Japanese Patent No. 3467943. This toner cloud collecting device is disposed close to a developing device in which developer that includes at least toner is contained in a developing housing having a developing opening. The toner cloud collecting device collects a toner cloud flowing out through the developing opening.

According to Japanese Patent No. 3467943, the toner cloud collecting device includes a cloud collecting housing, a suction applying device, and a suction distribution setting device. The duct-shaped could collecting housing has a cloud collecting opening. The suction applying device applies a suction to the toner cloud from the cloud collecting opening toward the inside of the cloud collecting housing. The suction distribution setting device sets the suction such that, in the cloud collecting opening, a suction to the toner cloud is larger at a portion corresponding to a region other than a passing region of a transfer medium of a preset reference size than that at another portion. A blower device serving as the suction applying device is disposed in a duct serving as the cloud collecting housing or a communicating portion of the duct. Meanwhile, an airflow amount adjusting member serving as the suction distribution setting device is provided near the cloud collecting opening of the duct serving as the cloud collecting housing. This airflow amount adjusting member has a plurality of gaps for adjusting the amount of airflow passing therethrough. The size of the gaps is set to be larger at the portion corresponding to the region other than the passing region of the transfer medium of the reference size than that at the other region.

SUMMARY

Aspects of non-limiting embodiments of the present disclosure relate to a developing device and an image forming apparatus including this developing device. When, out of an airflow generated by rotation of a developer holding device, part of the airflow that does not flow to an inside of a housing is introduced into and passes through, together with part of developer included in the airflow and flying, a through portion disposed at a portion of the housing including a downstream edge portion of a developing opening, this developing device is able to suppress passing or existing of relatively large amount of the developer through or in both end regions of the through portion in an axial direction of the developer holding device.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided a developing device including a housing, a developer holding device, and a directing device. The housing includes a container portion containing developer and has a developing opening. The developer holding device holds the developer in the container portion of the housing and is rotated so as to pass the developing opening. The developing device has a through portion disposed at a portion of the housing including a downstream edge portion at a downstream portion of the developing opening in a direction in which the developer holding device is rotated. The through portion has an inlet, an outlet, and a passage that connects the inlet and the outlet to each other so as to allow part of an airflow generated by rotation of the developer holding device to be introduced thereinto and flow therethrough. The directing device extends from a portion of the housing opposite to the developing opening with the inlet of the through portion interposed therebetween toward the developer holding device so as to direct the part of the airflow toward the inlet. In an axial direction of the developer holding device, an opening area of a portion of the inlet of the through portion disposed in a central region is larger than a total of opening areas of portions of the inlet of the through portion disposed in end regions.

BRIEF DESCRIPTION OF THE DRAWINGS

Exemplary embodiments of the present disclosure will be described in detail based on the following figures, wherein:

FIG. 10A is a schematic sectional view of the structure of the developing device, and FIG. 10B is a schematic sectional view of a state of operation of this developing device;

DETAILED DESCRIPTION

Exemplary embodiments of the present disclosure will be described below with reference to the drawings.

First Exemplary Embodiment

Figure 1:
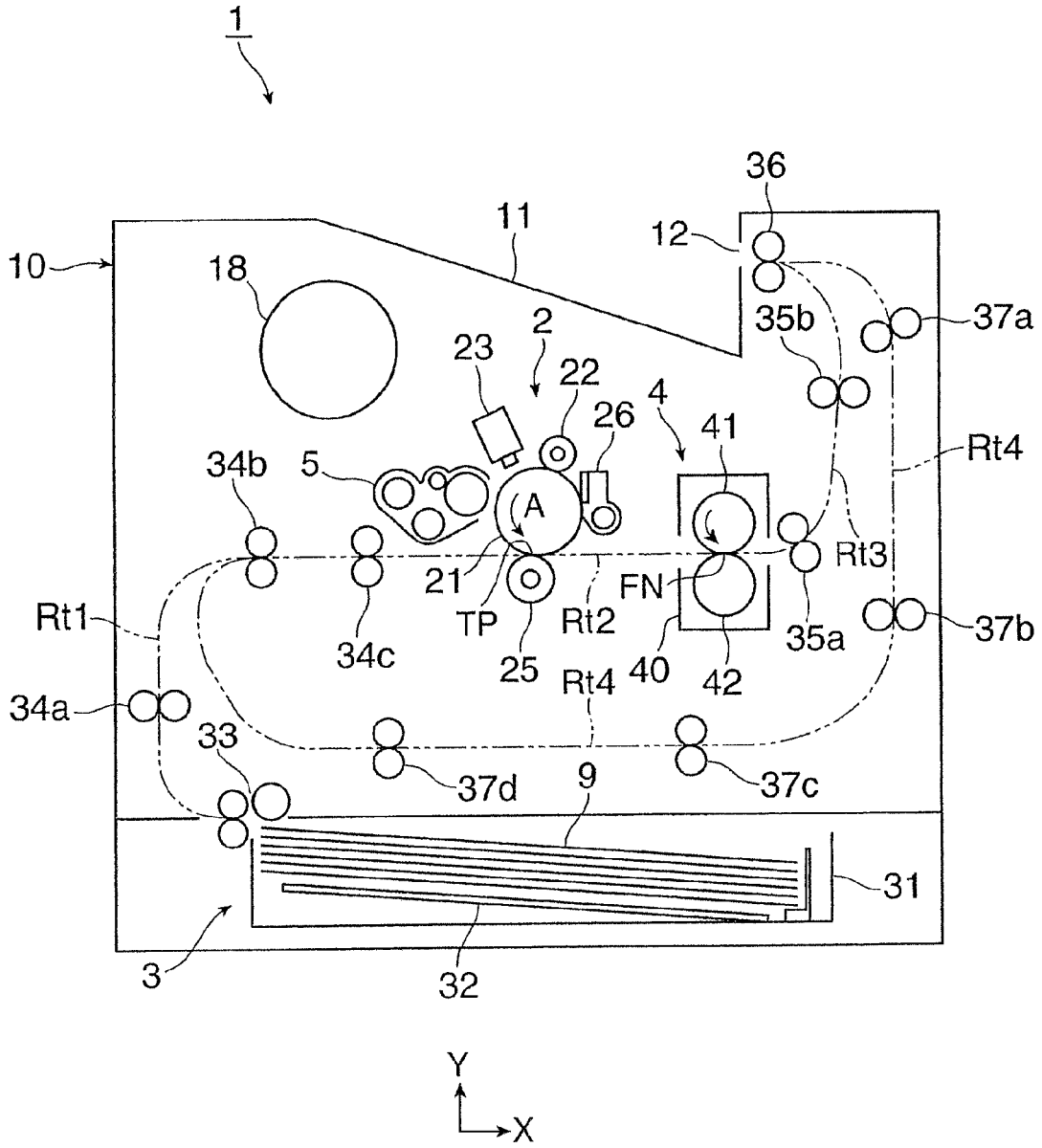
FIG. 1 is an overview illustrating the entirety of an image forming apparatus according to a first exemplary embodiment.
Figure 2:
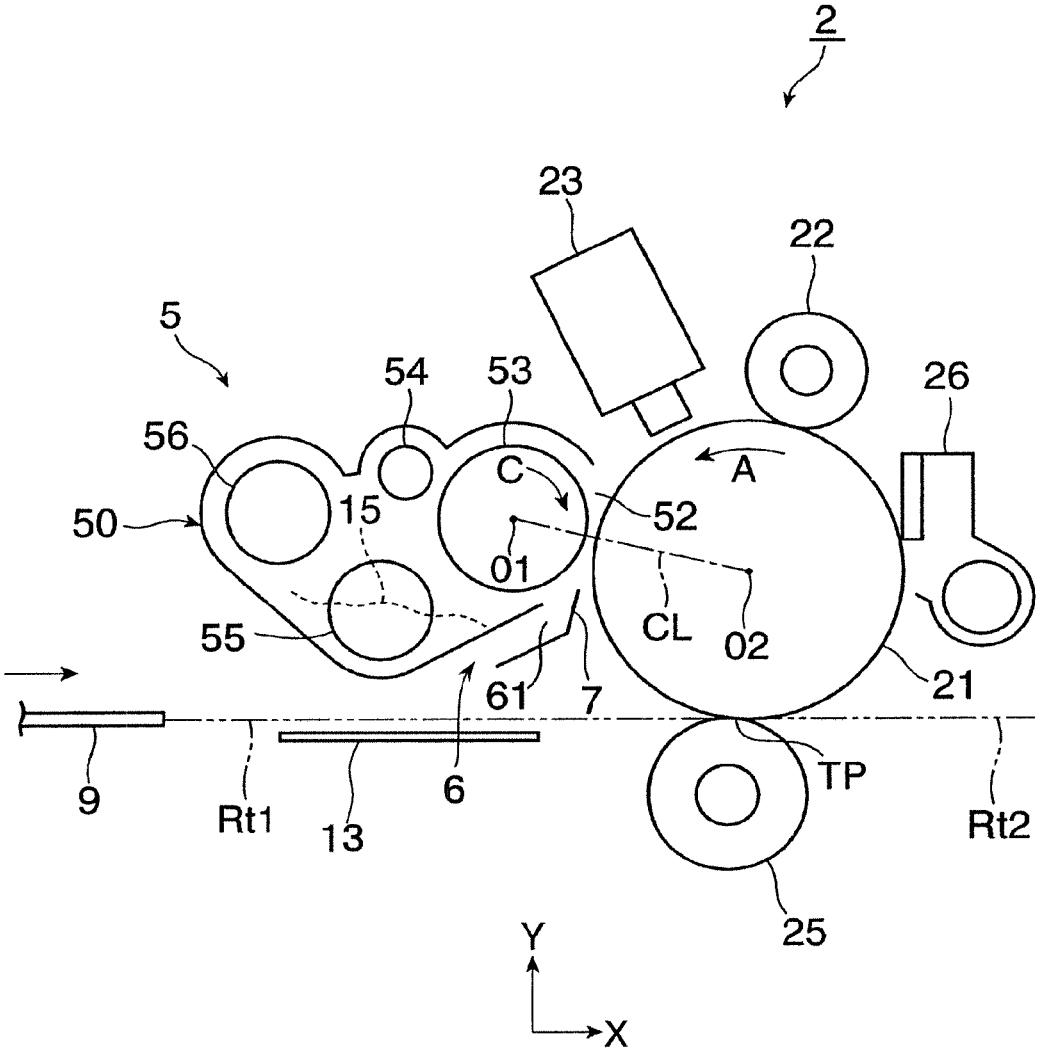
FIG. 2 is an enlarged overview of part (image making device including the developing device) of the image forming apparatus illustrated in FIG. 1.
Figure 3:
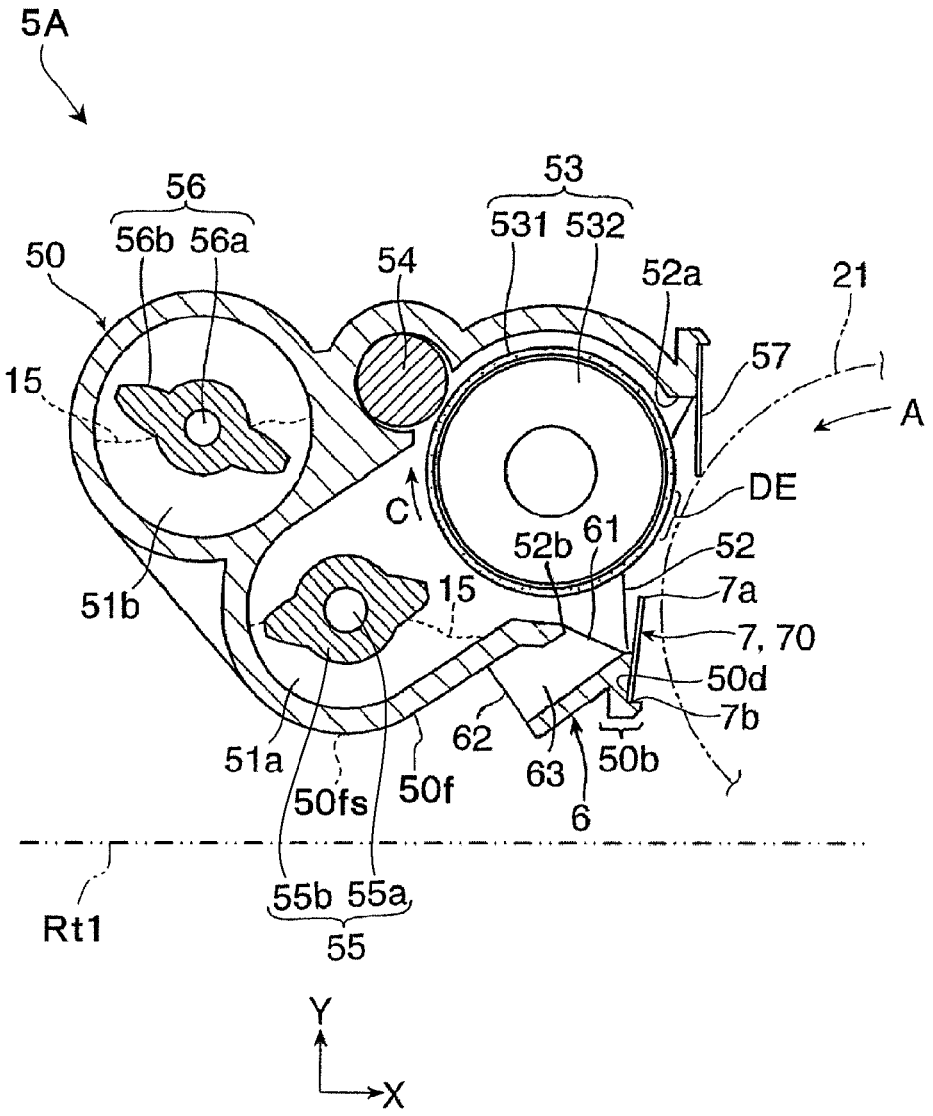
FIG. 3 is a schematic sectional view of the developing device used for the image forming apparatus illustrated in FIG. 1.

FIGS. 1 to 3 illustrate a first exemplary embodiment of the present disclosure. FIG. 1 illustrates the structure of an image forming apparatus 1 that includes a developing device according to the first exemplary embodiment. FIG. 2 is an enlarged view of part (image making device including the developing device) of the image forming apparatus 1. FIG. 3 is an enlarged view of the structure of the developing device used for the image forming apparatus 1.

Overall Structure of the Image Forming Apparatus

The image forming apparatus 1 is a printer as an example of an image forming apparatus. The image forming apparatus 1 forms images formed by developer (toner) on sheets of pater 9. The images are formed based on image information that is input from the outside and includes all or a subset of characters, photographs, graphics, and the like.

As illustrated in FIG. 1, the image forming apparatus 1 includes an image making device 2, a sheet feed device 3, a fixing device 4, and so forth disposed in a housing 10 serving as an apparatus body. The image making device 2 forms toner images including the toner as the developer by using an electrophotographic system or the like and transfers the toner images onto the sheets 9. The sheet feed device 3 contains the required sheets 9 and supplies the sheets 9 to a transfer position of the image making device 2. The fixing device 4 fixes the toner images transferred onto the sheets 9.

The housing 10 includes various members such as structural members, exterior members, and so forth. An output receiving unit 11 that receives the sheets 9 on which the images have been formed and which is output is provided in an upper portion of the housing 10. The output receiving unit 11 has a receiving surface including an inclined surface provided below an output opening 12 provided in the housing 10, thereby receiving the sheets 9 output from the output opening 12.

As illustrated in FIGS. 1 and 2, the image making device 2 includes a charger 22, a light exposure device 23, a developing device 5, a transfer device 25, a cleaner 26, and so forth arranged in this order around a photoconductor drum 21 that is to be driven so as to be rotated in an arrow A direction.

Out of these, the charger 22 is of a contact charging type or the like and charges a circumferential surface of the photoconductor drum 21 (an outer circumferential surface portion to serve as an image forming region) to a required polarity and a required potential. The light exposure device 23 forms on the charged circumferential surface of the photoconductor drum 21 electrostatic latent images by radiating light corresponding to image information (signals) input to the image forming apparatus 1 by a various method. The developing device 5 develops the electrostatic latent images on the photoconductor drum 21 so as to form toner images by supplying the toner as the developer. The transfer device 25 is of a contact transfer type or the like and electrostatically transfers the toner images on the photoconductor drum 21 onto the sheets 9. The cleaner 26 cleans the circumferential surface of the photoconductor drum 21 by removing unnecessary matter such as residual toner attracted to the circumferential surface of the photoconductor drum 21.

The details of the developing device 5 will be described later.

The sheet feed device 3 is disposed at a position separated from the image making device 2 toward a lower portion in the direction of gravity. The sheet feed device 3 includes sheet containers 31, a feed device 33, and so forth. The sheet containers 31 each contain a plurality of the sheets 9 of a required size, type and so force used for forming images. The plurality of sheets 9 contained in the sheet container 31 are stacked one on top of another on a placement plate 32. The feed device 33 feeds one sheet after another from the sheets 9 contained in the sheet container 31.

The sheet container 31 is attached to the housing 10 such that the sheet container 31 is able to be drawn out from the housing 10. A plurality of the sheet containers 31 are provided in accordance with the forms of application. It is sufficient that the sheets 9 be recording media that are able to be transported in the housing 10 and that allow the toner images to be transferred and fixed thereto. For example, normal paper, coated paper, cardboards, postcards, or the like cut into a predetermined size or envelopes are used.

The fixing device 4 is disposed at a position separated substantially horizontally (in a direction substantially parallel to the coordinate axis X) from the image making device 2. The fixing device 4 includes a heating rotating body 41, a pressure rotating body 42, and so forth. The heating rotating body 41 and the pressure rotating body 42 are disposed in a housing 40 having an introduction opening and an exit opening, in contact with each other, and to be rotated.

The heating rotating body 41 is a heating fixing member in the form of a roller, a belt, or the like. The heating rotating body 41 is, as illustrated in FIG. 1, rotated in an arrow direction. The heating rotating body 41 is heated by a heating device (not illustrated) such that the temperature of an outer circumferential surface thereof is maintained at a required temperature. The pressure rotating body 42 is a pressure-applying fixing member in the form of a roller, a belt, or the like. The pressure rotating body 42 is in contact with the heating rotating body 41 along a substantially axial direction of the heating rotating body 41 at a required pressure, thereby being rotated. Furthermore, in the fixing device 4, a portion where the heating rotating body 41 and the pressure rotating body 42 are in contact with each other is a fixing processing portion FN where the sheets 9 onto which unfixed toner images have been transferred pass through so as to be subjected to required fixing processing (such as heating, applying pressure, and so forth).

Furthermore, as illustrated by two-dot chain lines Rt in FIG. 1, the image forming apparatus 1 has sheet transport paths through which each of the sheets 9 is typically transported in the housing 10.

The typical sheet transport paths include, for example, a supply transport path Rt1, a relay transport path Rt2, an output transport path Rt3, and a duplex transport path Rt4. The supply transport path Rt1 is provided between the feed device 33 of the sheet feed device 3 and a transfer position TP (a position where the photoconductor drum 21 and the transfer device 25 face each other) of the image making device 2. The relay transport path Rt2 is provided between the transfer position TP of the image making device 2 and the fixing processing portion FN of the fixing device 4. The output transport path Rt3 is provided between the fixing processing portion FN of the fixing device 4 and the output receiving unit 11 of the housing 10. The duplex transport path Rt4 is provided between an end (branching portion) of the output transport path Rt3 and a middle position (merging portion) of the supply transport path Rt1.

Out of these transport paths, the supply transport path Rt1 is formed by using a plurality of transport roller pairs 34*a*, 34*b*, 34*c*, a plurality of transport guide members (not illustrated), and so forth to generally have a U shape turned substantially sideways. The transport roller pair 34*c* is a so-called registration roller pair that starts to be rotated at timing adjusted to transfer timing so as to feed the sheet 9 toward the transfer position TP of the image making device 2.

Furthermore, the supply transport path Rt1 is disposed so as to pass through a position below the developing device 5 in the direction of gravity upstream of the transfer position TP of the image making device 2 in the direction in which the sheet 9 is transported. At this time, in the supply transport path Rt1, a transport guide member 13 that guides a non-transfer surface (back side) of the sheet 9 may be disposed below the developing device 5 in the direction of gravity as exemplified in FIG. 2.

The relay transport path Rt2 is formed by using a plurality of transport guide members (not illustrated) so as to entirely extend in a generally horizontal direction.

The output transport path Rt3 is formed by using a plurality of transport roller pairs 35*a*, 35*b*, 36 and a plurality of transport guide members (not illustrated) to generally have a shape that extends upward while being curved. The transport roller pair 36 is an output roller pair that is provided immediately upstream of the output opening 12 in the direction in which the sheet 9 is transported and feeds the sheet 9 having undergone fixing to the output receiving unit 11.

The duplex transport path Rt4 includes the transport roller pair 36, a plurality of transport roller pairs 37*a*, 37*b*, 37*c*, 37*d*, a route switching member (not illustrated), a plurality of transport guide members (not illustrated), and so forth. The transport roller pair 36 serving as the output roller pair is the end of the output transport path Rt3 and rotatable in the normal and reverse directions. The route switching member switches the destination of the route of the sheet 9.

Image Forming Operation Performed by the Image Forming Apparatus

The image forming apparatus 1 forms images as follows. Here, the image forming operation is described with an example of a basic simplex image forming operation performed when an image is formed on one side of the sheet 9.

In the image forming apparatus 1, the image making device 2, the sheet feed device 3, the fixing device 4, and so forth start up when, for example, a controller (not illustrated) receives a request instruction (signal) for the image forming operation from an external information terminal or the like connected through various communication devices.

Initially, operations for forming an image is performed in the image making device 2. First, the photoconductor drum 21 starts rotation, and the charger 22 charges the circumferential surface of the photoconductor drum 21 to a specified polarity (negative polarity in the present example) and a specified potential. Then, the light exposure device 23 causes the charged circumferential surface of the photoconductor drum 21 to be exposed to light in accordance with the image information so as to form an electrostatic latent image including required patterns. After that, the developing device 5 performs developing by supplying the toner serving as the developer charged to a required polarity (negative polarity according to the present example) toward the electrostatic latent image formed on the circumferential surface of the photoconductor drum 21, thereby making the electrostatic latent image visible as a toner image formed by the toner. Thus, the toner image is formed on the photoconductor drum 21.

Next, in the image making device 2, the photoconductor drum 21 being rotated transports the toner image to the transfer position TP facing the transfer device 25. Meanwhile, in the sheet feed device 3, the sheet 9 is fed to the supply transport path Rt1 at timing adjusted to this transfer timing so as to be supplied to the transfer position TP of the image making device 2. At the transfer position TP of the image making device 2, the transfer device 25 forms a transfer electric field so as to electrostatically transfer the toner image on the photoconductor drum 21 onto the one side of the sheet 9. Furthermore, in the image making device 2, the cleaner 26 continues to clean the circumferential surface of the photoconductor drum 21 at a time including a time after this transfer.

Next, the sheet 9 onto which the toner image has been transferred is fed to the relay transport path Rt2 while being pinched between the photoconductor drum 21 being rotated and the transfer device 25 and subjected to a transport force so as to be transported to the fixing device 4. In the fixing device 4, the sheet 9 is introduced into and passes through the fixing processing portion FN between the heating rotating body 41 driven to be rotated in the arrow direction and the pressure rotating body 42 rotated by following the heating rotating body 41. When the sheet 9 passes through the fixing processing portion FN, the toner of the toner image on the one side of the sheet 9 is heated and fused under pressure so as to be fixed onto the sheet 9.

At last, the sheet 9 having undergone the fixing is fed from the fixing processing portion FN of the fixing device 4 to the output transport path Rt3 and transported. After that, the sheet 9 is output from the output opening 12 of the housing 10 by the transport roller pair 36, thereby finally being received in the output receiving unit 11.

Thus, a monochrome image formed of the toner of a single color is formed on the one side of a single sheet 9, and the simplex image forming operation is completed. When an instruction for performing the image forming operation on a plurality of the sheets 9 is issued, the above-described series of operations are similarly repeatedly performed as many times as the number of the sheets 9.

Furthermore, in a duplex printing operation for forming images on both the front and back sides of the sheet 9, the sheet 9 onto one side (first side: front side) of which the transferred toner image has been fixed is fed to the duplex transport path Rt4 after the above-described simplex image forming operation has been similarly performed.

In so doing, the sheet 9 onto the one side of which the toner image has been fixed is stopped in a state in which a leading end portion of the sheet 9, the leading end portion being at the leading end when the sheet 9 is transported, is temporarily output from the output opening 12 while being pinched between the transport roller pair 36. Then, by a displacement operation of the route switching member for switching the route and reverse rotating operation of the output roller pair 36, the sheet 9 is fed to the duplex transport path Rt4 first from a trailing end portion, the trailing end portion being at the trailing end when the sheet 9 transported.

Next, the sheet 9 having fed to the duplex transport path Rt4 is transported through the duplex transport path Rt4. Then, the sheet 9 is transported through a path that merges with the supply transport path Rt1 at a position of the supply transport path Rt1 upstream of the transport roller pair 34*b* in the sheet 9 transport direction. Thus, the sheet 9 having been inverted is fed to the supply transport path Rt1.

Finally, as is the case with the simplex image forming operation, the sheet 9 fed again to the supply transport path Rt1 is fed to the transfer position TP of the image making device 2 at the transfer timing, and a toner image is transferred onto the other side (second side: back side) of this sheet 9. After that, the sheet 9 is transported to the fixing device 4 and the toner image is fixed. At last, the sheet 9 on both the front and back sides of which the images have been formed is transported through the output transport path Rt3 similarly to the above-described case, and then output to and received in the output receiving unit 11.

Thus, monochrome images formed of the toner of a single color are respectively formed on the front and back sides of a single sheet 9, and the duplex image forming operation is completed.

Structure of the Developing Device

Next, the developing device 5 is described.

As illustrated in, for example, FIGS. 2 and 3, the developing device 5 includes a housing 50 that houses the elements disposed therein. Typically, elements such as a developing roller 53, a layer thickness regulating member 54, and two agitating transport members 55, 56 are disposed in the housing 50.

The entirety of the housing 50 has an external shape elongated in one direction. The housing 50 has, as illustrated in, for example, FIG. 3, a container portion 51, a developing opening 52, and so forth. The container portion 51 contains developer 15. The developing opening 52 opens a portion of the container portion 51 facing the photoconductor drum 21.

The housing 50 is separable into, for example, a body portion (housing lower portion) included in a lower structure of the housing 50 and a lid portion (housing upper portion) that closes an upper side of the housing 50 and is included in an upper structure of the housing 50. As the developer 15, so-called two-component developer that includes non-magnetic toner including fine powder colored with a desired color (such as black) and magnetic carrier including magnetic particles is used.

The container portion 51 of the housing 50 has two transport paths 51*a*, 51*b* (a first transport path 51*a* and a second transport path 51*b*) parallel to the axial direction of the developing roller 53.

The two transport paths 51*a*, 51*b* are parallel to each other and linearly extend in the longitudinal direction of the housing 50. The two transport paths 51*a*, 51*b* are in such a positional relationship in which the two transport paths 51*a*, 51*b* are disposed at slightly different positions in the up-down direction. Furthermore, central portions of the two transport paths 51*a*, 51*b* adjacent to each other are separated from each other by a separator wall. In contrast, the two transport paths 51*a*, 51*b* are connected to each other at connecting portions without separator wall at upstream end portions and downstream end portions in the transport direction of the two transport paths 51*a*, 51*b*. Thus, the two transport paths 51*a*, 51*b* form in combination a circulating path structure. Furthermore, out of the two transport paths 51*a*, 51*b*, the first transport path 51*a* close to the developing roller 53 is typically used as a supply transport path through which the developer 15 is supplied to the developing roller 53, and the second transport path 51*b* far from the developing roller 53 is typically used as a mixing transport path in which the developer 15 contained therein is mixed with newly replenished toner or the like.

The developing opening 52 allows part of the developing roller 53 to be exposed to the outside so as to perform the developing step. For this purpose, the developing opening 52 has, for example, a rectangular shape having a slightly larger dimension than that of an effective image forming region in the direction of the axis of rotation of the photoconductor drum 21. Reference numeral 57 in FIG. 3 denotes a leakage suppressing member, that is, a so-called sealing member that suppresses leakage of the developer 15 (typically, toner) through a gap between the developing device 5 and the photoconductor drum 21 and a gap between the developing opening 52 of the housing 50 and the developing roller 53.

The developing roller 53 holds at the outer circumferential surface thereof the developer 15 in the container portion 51 by a magnetic force and transports the held developer 15 to a surface portion DE serving as a developing performing region facing the outer circumferential surface of the photoconductor drum 21 with a required gap therebetween. The developer 15 transported to the surface portion DE passes through the surface portion DE. The developing performing region is a region having a predetermined width through the center of which a line CL (FIG. 2) connecting a center point of rotation 01 of the developing roller 53 and a center point of rotation 02 of the photoconductor drum 21 passes, or a region where a magnetic force of a developing magnetic pole disposed in a magnet roller (532) of the developing roller 53, which will be described later, effectively works.

As illustrated in FIG. 3, the developing roller 53 includes a sleeve 531 and the magnet roller 532. The sleeve 531 is an example of a cylindrical member provided so as to be rotated while partially being exposed from the developing opening 52 in the housing 50. The magnet roller 532 is an example of a magnet member secured in a cylindrical space of the sleeve 531.

Figure 4:
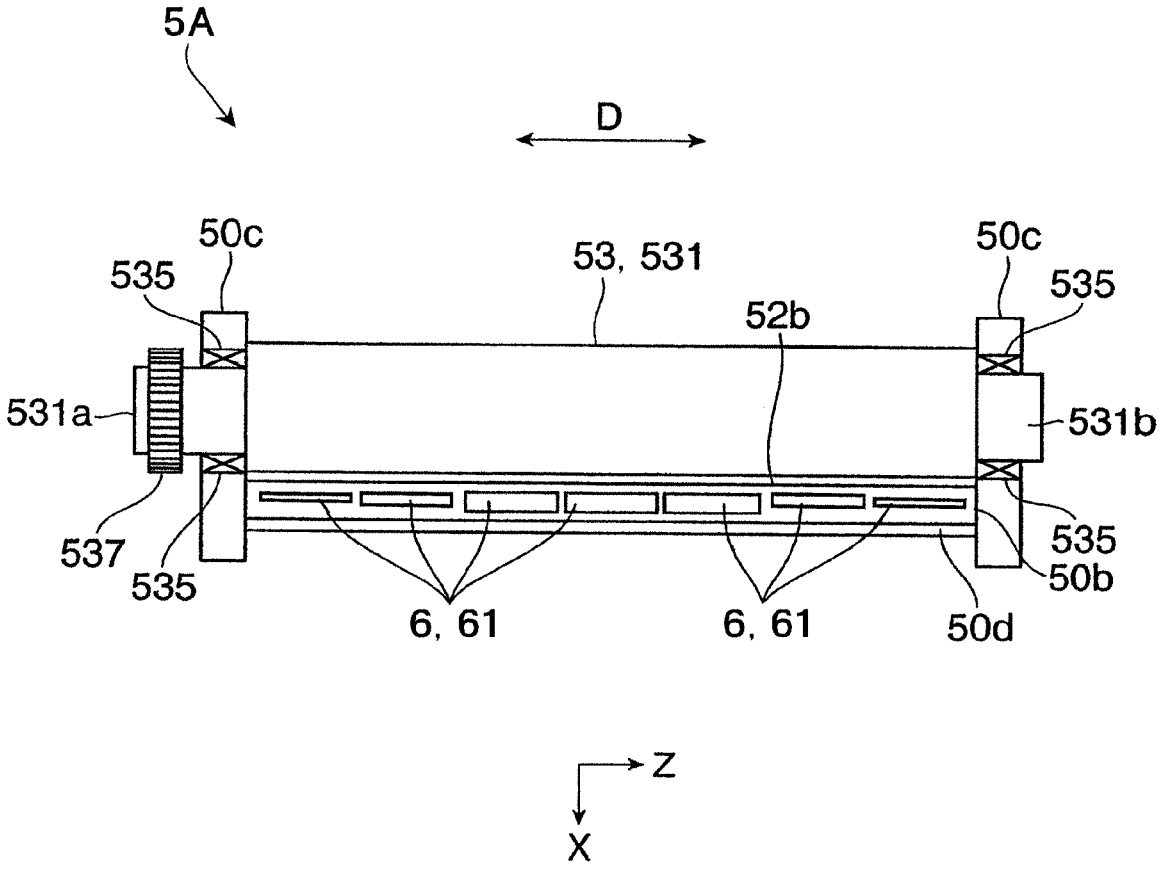
FIG. 4 is an overview of part of the developing device (with a directing device omitted) illustrated in FIG. 3.

The sleeve 531 is a cylindrical member formed of a non-magnetic material such as stainless steel or aluminum. For example, the sleeve 531 is mounted such that, as illustrated in FIG. 4, shaft portions 531*a*, 531*b* provided at respective ends of the sleeve 531 are rotatably mounted at mounting portions 50*c* provided at a side wall of the housing 50 with bearings 535 or the like interposed therebetween. Furthermore, for example, a gear 537 is mounted on the shaft portion 531*a* being one of the shaft portions 531*a*, 531*b*. This gear 537 receives rotational motive power transmitted from a rotational drive device (not illustrated) through a gear train or the like so as to rotate the sleeve 531 in an arrow C direction. Furthermore, a developing voltage is supplied from a power source (not illustrated) to a region between the sleeve 531 and the photoconductor drum 21.

Figure 6:
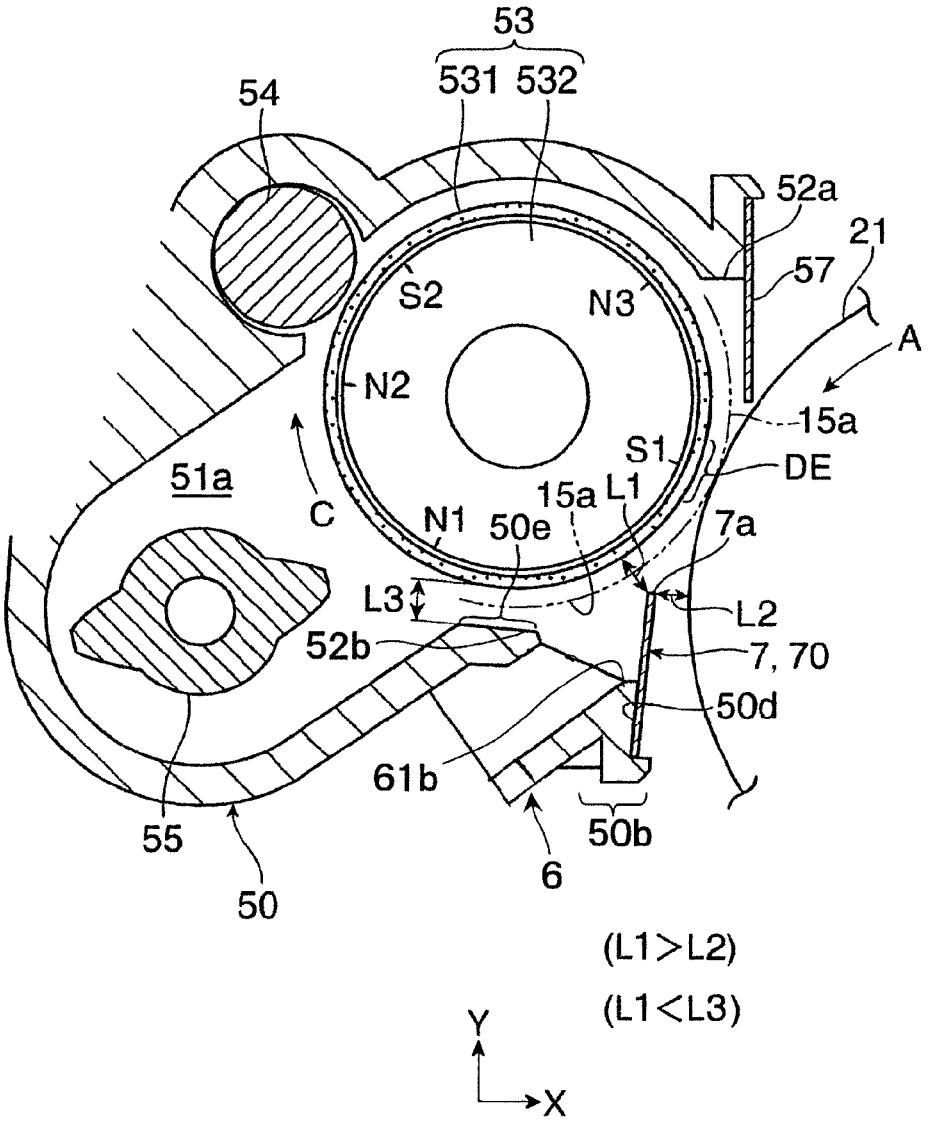
FIG. 6 is an enlarged schematic sectional view of the structure of part of the developing device.

Meanwhile, the magnet roller 532 has a structure in which, as illustrated in FIG. 6, a plurality of magnetic poles (south poles and north poles) are disposed at predetermined positions. These magnetic poles generate magnetic forces that cause the particles of the magnetic carrier of the developer 15 to be attracted so as to form a magnetic brush in which the particles of the magnetic carrier are continuously disposed to form a chain shape along magnetic lines of force on the outer circumferential surface of the sleeve 531. Referring to FIG. 6, reference numeral S1 denotes a developing magnetic pole, reference numeral N1 denotes a removing magnetic pole, reference numeral N2 denotes an attracting magnetic pole, reference numeral S2 denotes a layer thickness adjusting magnetic pole, and reference numeral N3 denotes a transport magnetic pole.

The magnet roller 532 is mounted such that, for example, shaft portions of the magnet roller 532 projecting from respective ends of the magnet roller 532 pass through respective inner spaces of the shaft portions 531*a*, 531*b* of the sleeve 531 and are secured to the respective mounting portions 50*c* on the side wall of the housing 50.

The layer thickness regulating member 54 regulates the thickness of a layer of the developer 15 (magnetic brush) held on the sleeve 531 of the developing roller 53 such that the layer thickness is maintained at a substantially uniform thickness.

The layer thickness regulating member 54 is mounted so as to be secured to a mounting portion formed in the housing 50 such that the layer thickness regulating member 54 is kept separated from the outer circumferential surface of the sleeve 531 of the developing roller 53 with a required gap (regulating gap) corresponding to the layer thickness required for the developer 15 set therebetween and the layer thickness regulating member 54 is maintained in a state in which the layer thickness regulating member 54 and the sleeve 531 face each other along an axial direction D of the rotation shaft (shaft portion) of the sleeve 531. For example, a cylindrical member having a length larger than or equal to the length of an effective developing region in the axial direction of the developing roller 53 (sleeve 531) is used for the layer thickness regulating member 54. More specifically, this cylindrical member is formed of a non-magnetic material such as, for example, stainless steel. Furthermore, the layer thickness regulating member 54 is disposed upstream of (above) the center of rotation of the developing roller 53 (the center of rotation of the shaft portion 531*a* of the sleeve 531 or the like) in the direction of gravity.

As illustrated in, for example, FIGS. 2 and 3, the two agitating transport members 55, 56 are separately disposed in the first transport path 51*a* and the second transport path 51*b* of the housing 50 and transport the developer 15 contained in the respective transport paths 51*a*, 51*b* in the required directions (transport directions of the transport paths 51*a*, 51*b*) while agitating the developer 15.

For each of the agitating transport members 55, 56, a structure in which a plate-shaped transport portion 55*b*, 56*b* is spirally wound on a circumferential surface of a rotation shaft 55*a*, 56*a* (so-called screw auger) is used. Furthermore, both end portions of the rotation shaft 55*a*, 56*a* of each of the agitating transport members 55, 56 are rotatably mounted on bearings (not illustrated) provided on the side wall surface of the housing 50. Furthermore, a gear (not illustrated) is mounted on one end portion of the rotation shaft 55*a*, 56*a* of each of the agitating transport members 55, 56, thereby the agitating transport member 55, 56 is rotated in a required direction by receiving the rotational drive power distributed from the developing roller 53 (sleeve 531).

Basic Operation of the Developing Device

In the developing device 5 having the above-described structure, when time of operation such as the image forming operation by the image forming apparatus 1 comes, the sleeve 531 of the developing roller 53 and the agitating transport members 55, 56 start to be rotated and the developing voltage is supplied to the developing roller 53 and the sleeve 531.

Thus, the two-component developer 15 contained in the container portion 51 of the housing 50 is transported in the predetermined directions through the first transport path 51*a* and the second transport path 51*b* of the container portion 51 while being agitated by the rotating agitating transport members 55, 56 and transported so as to be moved at the end portions for transportation in the transport paths 51*a*, 51*b* to the other transport paths 51*b*, 51*a* through the connecting portions (not illustrated). Thus, the developer 15 is transported so as to be circulated in a single direction when the entirety of the container portion 51 is seen. In so doing, the non-magnetic toner of the developer 15 and the magnetic carrier of the developer 15 are sufficiently agitated, and the non-magnetic toner is triboelectrically charged and electrostatically attracted to the surfaces of the magnetic carrier.

Next, part of the developer 15 transported by the agitating transport member 55 disposed close to the developing roller 53 is attracted to and held on the outer circumferential surface of the sleeve 531 of the developing roller 53 due to the magnetic forces generated by the magnetic poles of the magnet roller 532. In so doing, the developer 15 is held in a state in which the napped magnetic brush is formed on the outer circumferential surface of the sleeve 531 rotated in the arrow C direction. Furthermore, passing of the held developer 15 is partially regulated so as to cause the held developer 15 to have a substantially uniform layer thickness (height of the magnetic brush) when the held developer 15 passes through a required gap (regulating gap) formed between the outer circumferential surface of the sleeve 531 and the layer thickness regulating member 54 during transportation of the held developer 15 by the rotation of the sleeve 531.

Next, the developer 15 having passed the layer thickness regulating member 54 is transported to the developing performing region DE facing the photoconductor drum 21 after having passed the developing opening 52 by the rotation of the sleeve 531. The developer 15 passes through the developing performing region DE with a distal end of the magnetic brush brought into contact with the outer circumferential surface of the photoconductor drum 21. During this passing, due to the developing (alternating) electric field formed between the developing roller 53 and the photoconductor drum 21 by the developing voltage including an alternating current supplied to the sleeve 531, only the toner of the developer 15 is electrostatically attracted to part on the photoconductor drum 21 where the electrostatic latent image is formed while being moved in a reciprocating manner between the developing roller 53 and the photoconductor drum 21. In this way, the developing device 5 develops the electrostatic latent image.

The developer 15 on the developing roller 53 that has passed through the developing performing region DE without contributing to the above-described developing step passes the developing opening 52 and is transported to the inside of the housing 50 while being held on the outer circumferential surface of the sleeve 531 due to the magnetic forces. After that, this developer 15 is principally subjected to an action of a repulsive magnetic pole of the magnet roller 532 so as to be removed from the sleeve 531 and returned to the inside of the container portion 51 (actually, the first transport path 51*a*). The removed and returned developer 15 is agitated and transported again by the agitating transport member 55 in the first transport path 51*a*, and then transported in a circulating manner by passing through the second transport path 51*b* and being returned again to the first transport path 51*a* so as to be reused.

In addition, in the developing device 5, the toner of the developer 15 in the container portion 51 is consumed and reduced in amount because of the supplying of the toner from the developing roller 53 to the photoconductor drum 21 due to the above-described developing operation. Accordingly, to compensate for the reduced amount of toner, the container portion 51 (the second transport path 51*b*) is replenished with new toner from a detachable toner container 18 by using a replenishing device (not illustrated) through a replenishing path (not illustrated).

Detailed Structure of the Developing Device

Figure 8A:
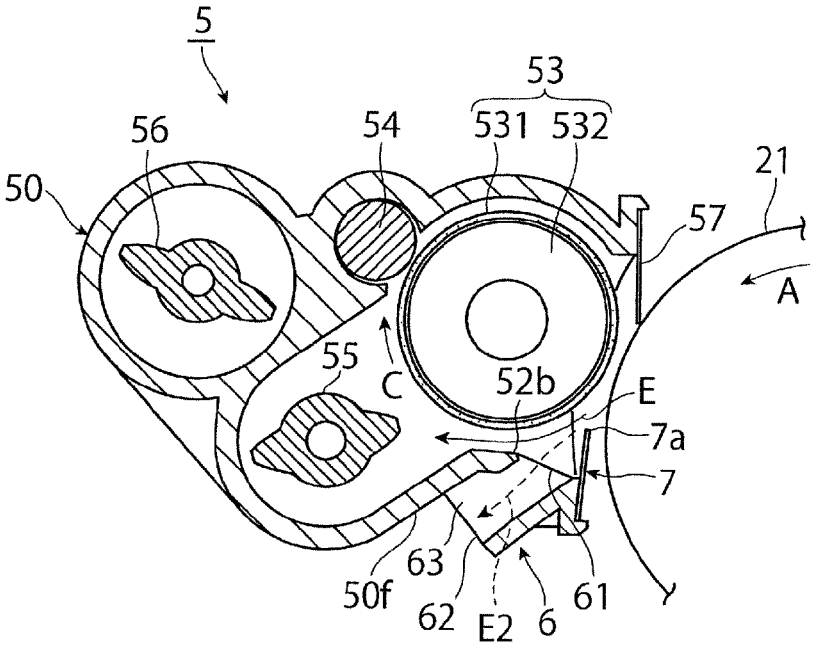
FIG. 8A is a schematic sectional view of a state of operation of the developing device illustrated in FIG. 3.

Meanwhile, in this developing device 5, when the developing roller 53 (sleeve 531) is rotated in the arrow C direction, as exemplified by, for example, a solid arrow in FIG. 8A, an airflow E that flows so as to move in the substantially same direction as a rotating direction C of the developing roller 53 (sleeve 531) is generated near the surface of the developing roller 53 (sleeve 531).

At this time, due to the rotation of the developing roller 53, part of the airflow E passes through a gap between the developing roller 53 and a downstream edge portion 52*b* of the developing opening 52 of the housing 50 and flows to the inside of the housing 50 (container portion 51).

However, since the developing roller 53 and the agitating transport members 55, 56 are rotated in the housing 50 of the developing device 5 during operation, the pressure inside the housing 50 (inner pressure) is higher than the pressure outside the housing 50. Thus, part of the airflow E (hereafter, this part of the airflow E is referred to as "airflow E1") is, as exemplified by a solid arrow in FIG. 8B, unable to flow to the inside of the housing 50 due to obstruction caused by the pressure difference and flows in a redirected path so as to be turned around.

As a result, in many cases with the developing device 5, part of the developer 15 (toner) flies up due to the effect of the airflow E1 flowing so as to be turned around, and the flying-up developer (a so-called toner cloud) is borne by the airflow E1 and flies so as to be dispersed to the outside of the housing 50.

Here, examples of the part of the developer flying up due to the effect of the airflow E1 include, for example, the following: part of the developer 15 that has been held at a portion of the sleeve 531 of the developing roller 53 immediately before entering the inside of the housing 50 (toner attracted to the carrier of the magnetic brush according to the present example) and is removed and flies; and the developer 15 (toner according to the present example) that is not returned to the inside of the housing 50 (container portion 51) and remains attracted to the downstream edge portion 52*b* of the developing opening 52 or the like.

Examples of spaces outside the housing 50 to which the developer 15 is scattered include, for example, the following: a gap between the developing device 5 and the photoconductor drum 21 that the developing device 5 faces; a gap between the developing device 5 and the light exposure device 23; and a gap from the developing device 5 to the transfer device 25 along the photoconductor drum 21.

Accordingly, in the developing device 5, a through portion 6 and a directing member 7 are provided at specified positions in the housing 50 as illustrated in, for example, FIGS. 2 to 4. The airflow E1 that is part of the airflow generated by the rotation of the developing roller 53 and that does not flow to the inside of the housing 50 is introduced into and flows through the through portion 6. The through portion 6 has an inlet 61, an outlet 62, and a passage 63. The directing member 7 serving as an example of a directing device directs the airflow E1 to the inlet 61 of the through portion 6.

Out of these, the through portion 6 is provided in, as illustrated in, for example, FIG. 3, a portion 50*b* including the downstream edge portion 52*b* at a downstream portion of the developing opening 52 of the housing 50 in the rotating direction C of the developing roller 53.

The portion 50*b* including the downstream edge portion 52*b* of the developing opening 52 projects in the direction separating from the developing roller 53 with reference to the downstream edge portion 52*b*. Reference numeral 52*a* in, for example, FIG. 3 denotes an upstream edge portion on the upstream side of the developing opening 52 in the rotating direction C of the developing roller 53.

The through portion 6 allows the airflow E1 being part of the airflow E generated by the rotation of the developing roller 53 to be introduced thereinto and flow along the outer circumferential surface of the housing 50. Thus, the through portion 6 is a penetrated portion having a shape substantially following an outer surface of a lower portion of the housing 50.

In the image forming apparatus 1 according to the first exemplary embodiment, as illustrated in FIGS. 2 and 3, the developing device 5 having the through portion 6 is disposed close to a position above the supply transport path Rt1 (upstream of the supply transport path Rt1 in the direction of gravity) upstream of the transfer position TP of the image making device 2 in the sheet 9 transport direction. That is, in the image forming apparatus 1, a space between the developing device 5 and the supply transport path Rt1 is comparatively small.

Accordingly, from the viewpoint of sufficiently allocating a transport space or the like for the sheet 9 in the supply transport path Rt1, it is difficult to provide the through portion 6 such that the through portion 6 passes through a lowest portion 50*fs* and extends in the direction separating from the developing opening 52. Here, the lowest portion 50*fs* (portion closest to the supply transport path Rt1) is a portion of an outer surface 50*f* of the housing 50 of the developing device 5. The outer surface 50*f* obliquely extends downward from the downstream edge portion 52*b* of the developing opening 52 so as to approach the supply transport path Rt1.

For this reason, the through portion 6 ends at a position slightly above the lowest portion of the outer surface 50*f* of the housing 50. In other words, the through portion 6 does not project from the lowest portion of the outer surface 50*f* toward the supply transport path Rt1.

The inlet 61 included in the through portion 6 is provided close to the downstream edge portion 52*b* of the developing opening 52 and extends in an axial direction D of the developing roller 53 in the housing 50. As illustrated in, for example, FIG. 5, the inlet 61 has a plurality of (seven according to the present example) openings 61A1, 61A2, 61A3, 61B1, 61B1, 61B2, 61B2 separated in the axial direction D of the developing roller 53. Each of the openings has a rectangular shape.

The outlet 62 included in the through portion 6 is provided below the downstream edge portion 52*b* of the developing opening 52 separated from the downstream edge portion 52*b* of the developing opening 52 by a required distance along the outer surface 50*f* below the downstream edge portion 52*b* of the developing opening 52 and extends in the axial direction D of the developing roller 53 in the housing 50. The outlet 62 has a rectangular shape elongated in the axial direction D of the developing roller 53.

Furthermore, the passage 63 included in the through portion 6 is a through space that extends along the outer surface 50*f* so as to connects the inlet 61 to the outlet 62. The top surface (upper surface) of the passage 63 has a shape following the shape of the outer surface 50*f* of the housing 50, and the bottom surface (lower surface) of the passage 63 is substantially flat. Furthermore, the sectional shape of the passage 63 taken along a plane along the axial direction D of the developing roller 53 has an elongated rectangular shape.

Furthermore, as illustrated in FIG. 4, the inlet 61, the outlet 62, and the passage 63 of the through portion 6 extend in the axial direction D of the developing roller 53 at least within the width of (the downstream edge portion 52*b* of) the developing opening 52 in the housing 50. As illustrated in FIG. 4, the axial direction D of the developing roller 53 extends along a line connecting the centers of rotation of the shaft portions 531*a*, 531*b* corresponding to the rotation shaft of the developing roller 53.

Figure 5:
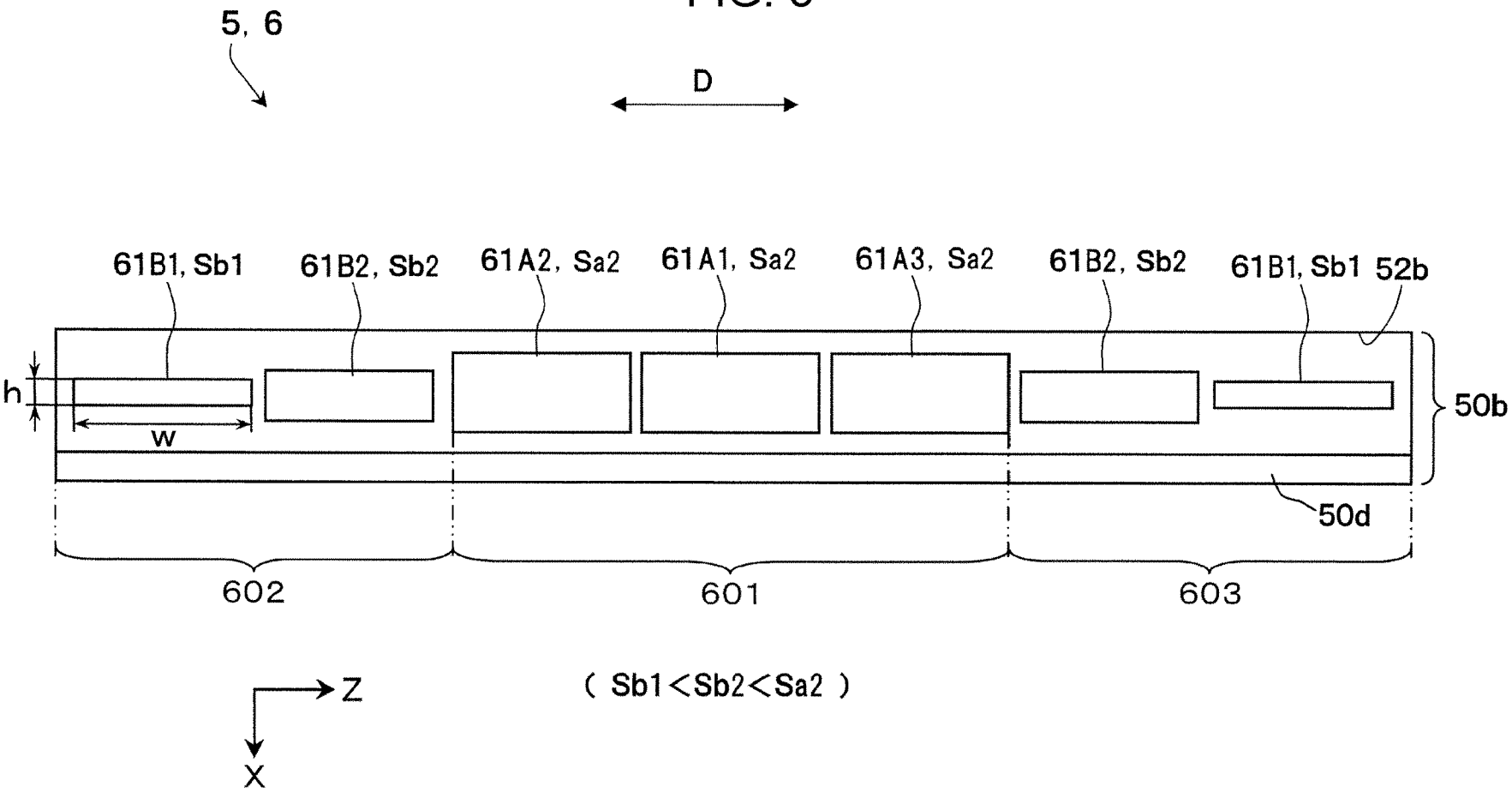
FIG. 5 is an overview of the structure of an inlet of a through portion of the developing device illustrated in FIG. 5.

In the through portion 6 of the developing device 5, as illustrated in FIGS. 4 and 5, an opening area S1 of portions of the inlet 61 disposed in a central region 601 in the axial direction D of the developing roller 53 is larger than an opening area S2 of portions of the inlet 61 disposed in both end regions 602, 603 in the axial direction D. That is, the inlet 61 of the through portion 6 is formed such that a magnitude relationship in which the opening area S1> the opening area S2 is established.

Here, as illustrated in FIG. 5, both the end regions 602, 603 in the axial direction D of the developing roller 53 are respectively disposed near the left and right ends in the width direction of the downstream edge portion 52*b* of the developing opening 52 and each have a width of, for example, ⅓ to ¼ of the entire width of the downstream edge portion 52*b*. Meanwhile, as illustrated in FIG. 5, the central region 601 is disposed at a region other than both the end regions 602, 603, that is, at or near the center in the width direction of the downstream edge portion 52*b* of the developing opening 52 and has a width of, for example, ½ to ⅓ of the entire width of the downstream edge portion 52*b*.

Furthermore, the opening area S1 of the portions disposed in the central region 601 is the total of opening areas of inlet portions disposed in the central region 601. In the case of the inlet 61 of the present example, since three identical openings 61A1, 61A2, 61A3 are disposed in the central region 601, the opening area S1 is the total of opening areas of these openings Sa2, Sa2, Sa2, that is, Sa2+Sa2+Sa2.

Meanwhile, the opening area S2 of the portions disposed in both the end regions 602,603 is the total of opening areas of inlet portions disposed in both the end regions 602, 603. In the case of the inlet 61 of the present example, since two identical openings 61B1, 6132 are similarly disposed in each of the end region 602,603, the opening area S2 is the total of these opening areas Sb1, Sb2, Sb1, Sb2, that is, Sb1+Sb2+Sb1+Sb2.

Furthermore, the inlet 61 of the through portion 6 is structured such that, regarding the two identical openings 61B1, 61B2 disposed in each of the end regions 602, 603, the magnitude relationship between the opening areas Sb1, Sb2 of the openings 61B1, 61B2 is Sb1<Sb2. Meanwhile, the inlet 61 is structured such that, regarding the three openings 61A1, 61A2, 61A3 disposed in the central region 601, the magnitude relationship between the opening areas Sa2, Sa2, Sa2 of the openings 61A1, 61A2, 61A3 is Sa2=Sa2=Sa2.

The seven openings 61A1, 61A2, 61A3, 61B1, 61B1, 61B2, 61B2 of the inlet 61 according to the first exemplary embodiment each have a width w in the direction along the axial direction D of the developing roller 53 and a height h in the direction substantially perpendicular to the axial direction D of the developing roller 53. The seven openings 61A1, 61A2, 61A3, 61B1, 61B1, 61B2, 61B2 have the same width w and the height of one of three different dimensions.

More specifically, the height h (h1) of the opening 61B1 disposed close to the outside in each of the end regions 602, 603 has a smallest dimension, the height h (h3) of each of the three openings 61A1, 61A2, 61A3 disposed in the central region 601 has a largest dimension, and the height h (h2) of the opening 61B2 disposed further to the inside than the opening 61B1 in each of the end regions 602, 603 is set to be an intermediate dimension (h1<h2<h3).

From the viewpoint of, for example, reliably introducing the above-described airflow E1 through the inlet 61 of the through portion 6, the height h of each of the plurality of openings of the inlet 61 is set to be larger than the dimension of a gap L1 (FIG. 6) between the developing roller 53 and the directing member 7, which will be described later.

Furthermore, the center of the height h of the seven openings 61A1, 61A2, 61A3, 61B1, 61B1, 61B2, 61B2 of the inlet 61 according to the first exemplary embodiment is positioned on a line extending in the axial direction D of the developing roller 53 (center line in the height direction). Also, the seven openings 61A1, 61A2, 61A3, 61B1, 61B1, 61B2, 61B2 are arranged in a single transverse row and spaced from one another by very small gaps of the same value (for example, about 8 to 20 mm) therebetween.

Meanwhile, as illustrated in, for example, FIGS. 3 and 6, the directing member 7 extends from a portion 50*d*, which is disposed opposite to the developing opening 52 with the inlet 61 of the through portion 6 interposed therebetween in the housing 50, toward the developing roller 53.

In this case, the portion 50*d* disposed opposite to the developing opening 52 with the inlet 61 of the housing 50 interposed therebetween is formed by a substantially smooth surface that extends in the axial direction D of the developing roller 53 from an end portion 61*b* of the inlet 61 far from the downstream edge portion 52*b* of the developing opening 52 and extends toward the opposite side from the end portion 61*b*. The portion 50*d* of the housing 50 according to the first exemplary embodiment is formed by a surface has an angle adjusted to a mounting angle of the substantially flat-shaped directing member 7.

The directing member 7 according to the first exemplary embodiment includes a flat plate-shaped film member 70, which is made by forming a synthetic resin film (sheet) such as polyethylene terephthalate (PET) into an elongated rectangular shape. The directing member 7 including the film member 70 is structured such that a portion including an end portion 7*a* being a free end of the film member 70 hardly shakes even when being brought into contact with an airflow generated by the rotation of the developing roller 53 or the like. Furthermore, in the case of the directing member 7 including the film member 70, for example, a portion near an end portion 7*b* (proximal end portion) of the directing member 7 far from the developing roller 53 is mounted on and secured to the portion 50*d* of the housing 50 with a securing material such as an adhesive.

Furthermore, as illustrated in FIG. 6, the end portion (free end) 7*a* of the directing member 7 close to the developing roller 53 is not brought into contact with the developer 15 (magnetic brush) held on the surface of the developing roller 53 (sleeve 531). Reference numeral 15*a* in FIG. 6 denotes a surface layer (outermost) portion of the napped magnetic brush formed by the developer 15 on the surface of the developing roller 53.

Figure 7A:
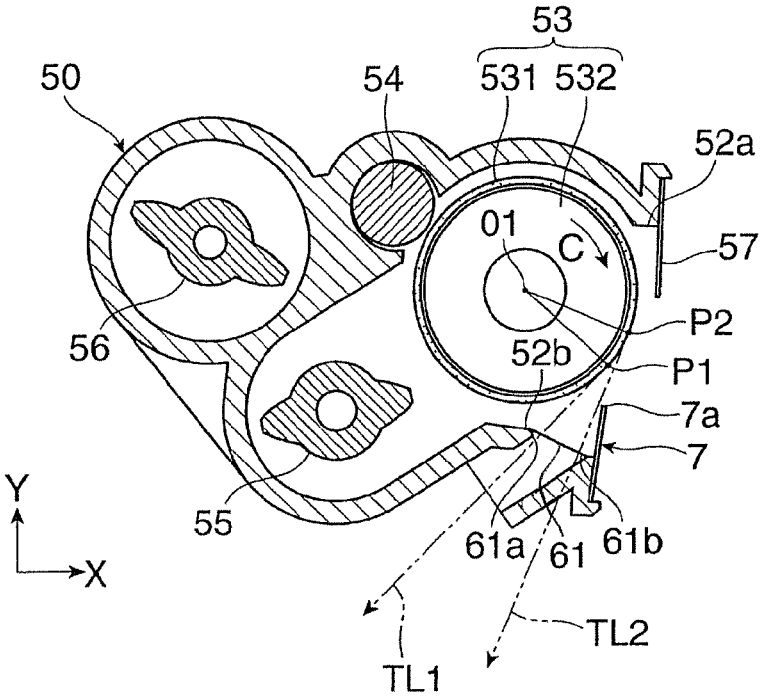
FIG. 7A is a schematic sectional view of a state of operation of the developing device.

Other than the above description, the inlet 61 of the through portion 6 according to the first exemplary embodiment is, as illustrated in FIG. 7A, provided such that the openings (opening surface) of of the inlet 61 intersect a subset of tangents (such as TL1, TL2, and so forth) out of an infinite number of the tangents TL that extend in the rotating direction C of the developing roller 53 (sleeve 531) at the surface of the developing roller 53 (sleeve 531). Use of such a structure may facilitate introduction of the airflow E generated by the rotation of the developing roller 53 into the inlet 61 of the through portion 6. Thus, dispersion of the flying developer 15 to the outside of the housing 50 may be easily suppressed.

The tangent TL1 exemplified in FIG. 7A passes through a point of contact P1 at the developing roller 53 (sleeve 531) and intersects and passes through a position near an end portion 61*a* of the inlet 61 close to the downstream edge portion 52*b* of the developing opening 52. The tangent TL2 exemplified in FIG. 7A passes through a point of contact P2 at the developing roller 53 (sleeve 531) and intersects and passes through a position near the end portion 61*b* of the inlet 61 far from the downstream edge portion 52*b* of the developing opening 52. In particular, the tangent TL2 exemplified in FIG. 7A is in contact relationship with the end portion 7*a* of the directing member 7 close to the developing roller 53.

Accordingly, the inlet 61 intersects at least many tangents TL existing between the two tangents TL1 and TL2 and also intersects a plurality of tangents existing outside the two tangents TL1 and TL2.

Figure 7B:
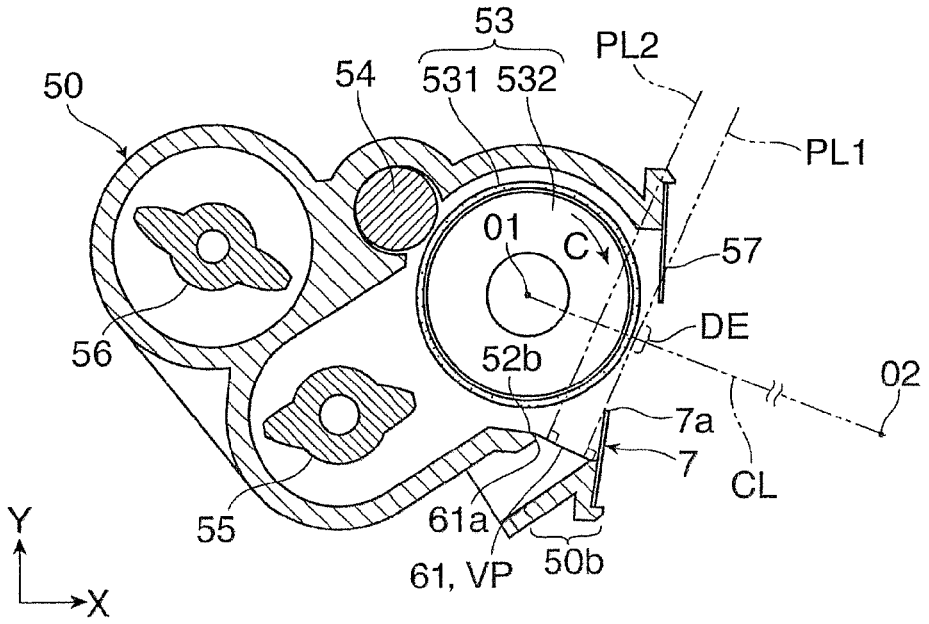
FIG. 7B is a schematic sectional view of a next state of the operation of the developing device.

Furthermore, the inlet 61 is provided such that, as illustrated in FIG. 7B, a subset (such as PL1 and PL2) of many perpendicular lines PL to a virtual plane VP that covers the openings of the inlet 61 extend so as to pass through the surface portion DE serving as the developing performing region of the developing roller 53 (sleeve 531) or a region further to the inside of the developing roller 53 (the sleeve 531 and the magnet roller 532) than the surface portion DE.

With such a structure, another part of the airflow E (referred to as "airflow E3" hereafter) may easily directly enter the inlet 61 of the through portion 6, and an airflow directed by the directing member 7 may easily enter the inlet 61 as will be described later.

The perpendicular line PL1 exemplified in FIG. 7B is an example of perpendicular lines that extend so as to pass through the surface portion DE serving as the developing performing region of the developing roller 53 (sleeve 531). In particular, the perpendicular line PL1 exemplified in FIG. 7B is also in such a relationship with the end portion 7*a* of the directing member 7 close to the developing roller 53 that the perpendicular line PL1 extends so as to be in contact with the end portion 7*a*.

Furthermore, the perpendicular line PL2 exemplified in FIG. 7B is an example of perpendicular lines that extend so as to pass through a region further to the inside of the developing roller 53 than the surface portion DE serving as the developing performing region of the developing roller 53 (sleeve 531). This perpendicular line PL2 is also a perpendicular line extending from a position near the end portion 61*a* of the inlet 61 (plane VP) close to the downstream edge portion 52*b* of the developing opening 52.

Thus, the following relationship is particularly established regarding the inlet 61: the perpendicular lines that extend so as to pass through the region further to the inside of the developing roller 53 than the surface portion DE serving as the developing performing region of the developing roller 53 (PL2) is more than the perpendicular lines that extend so as to pass through the surface portion DE serving as the developing performing region (PL1). Thus, a larger part of the inlet 61 faces the developing roller 53 instead of the photoconductor drum 21.

Meanwhile, as illustrated in FIG. 6, the end portion 7*a* of the directing member 7 according to the first exemplary embodiment close to the developing roller 53 is closer to the photoconductor drum 21 serving as an example of an image holding body that holds an electrostatic latent image to be developed than to the developing roller 53.

That is, the directing member 7 at this time satisfies a magnitude relationship in which the gap L1 that is a smallest gap between the end portion (free end) 7*a* of the directing member 7 and the developing roller 53 is larger than a smallest separation distance L2 between the end portion 7*a* of the directing member 7 and the photoconductor drum 21 (L1>L2).

Furthermore, as illustrated in FIG. 6, the end portion 7*a* of the directing member 7 according to the first exemplary embodiment close to the developing roller 53 is closer to the developing roller 53 than a jaw portion 50*e* of the housing 50 having a shape following the circumferential surface of the developing roller 53 (sleeve 531).

That is, the directing member 7 at this time satisfies a magnitude relationship in which the gap L1 that is a smallest gap between the end portion (free end) 7*a* of the directing member 7 and the developing roller 53 is smaller than a separation distance L3 that is a smallest distance between the jaw portion 50*e* of the housing 50 and the developing roller 53 (L1<L3).

The jaw portion 50*e* of the housing 50 has an arcuate sectional shape substantially following the (radius of curvature) of the cylindrical circumferential surface of the cylindrical sleeve 531 and extends in the axial direction D of the sleeve 531 to have a belt shape.

Furthermore, as illustrated in FIG. 6, in the magnet roller 532 of the developing roller 53 of this developing device 5, the magnetic pole N1 at a next magnetic pole position to that of the developing magnetic pole S1 in the rotating direction C of the sleeve 531 is disposed at a position that is deviated from the jaw portion 50*e* of the housing 50 having a shape following the circumferential surface of the cylindrical sleeve 531 and downstream of the jaw portion 50*e* in the rotating direction C of the sleeve 531.

According to the first exemplary embodiment, the magnetic pole N1 at the next magnetic pole position is used as the removing magnetic pole. Furthermore, in the magnet roller 532, the removing magnetic pole N1 is disposed downstream of and separated by a predetermined distance from a position in the rotating direction C of the sleeve 531. This position faces a downstream end portion of the jaw portion 50*e* of the housing 50 in the rotating direction C. At this time, it is sufficient that the removing magnetic pole N1 be disposed such that the peak position of a magnetic line pattern generated by the removing magnetic pole N1 in the direction of the normal passes through the jaw portion 50*e* of the housing 50 and exists in the container portion 51 (first transport path 51*a*).

With such a structure, the developer 15 held on the developing roller 53 is subjected to a magnetic action caused by the removing magnetic pole N1 of the magnet roller 532 at a portion (container portion 51) further to the inside than the jaw portion 50*e* of the housing 50. Thus, the developer 15 is removed and flies up. This may reduce the likelihood of the flying developer 15 (toner) being borne by the airflow E1, which is generated at a portion upstream of the jaw portion 50*e* in the rotating direction C of the sleeve 531 and flowing in a folding path, so as to be transported to the outside of the housing 50.

Detailed Operation of the Developing Device

In this developing device 5, when predetermined time of operation of the developing device 5 comes, as described above, the airflow E, which flows so as to move in the substantially same direction as the rotating direction C of the developing roller 53, is generated near the surface of the developing roller 53 (sleeve 531) being rotated (FIG. 8A).

In so doing, as indicated by a dotted arrow in FIG. 8A, an airflow E2 being part of the airflow E may flow into the inlet 61 of the through portion 6 that is opened near the downstream edge portion 52*b* of the developing opening 52 of the housing 50.

When there is an airflow that directly flows into the inlet 61 of the through portion 6 such as the airflow E2, the flying toner generated due to the effect of the airflow E1, which will be described later and flows so as to fold back instead of flowing to the inside of the housing 50, is borne by the airflow E2 so as to be transported into the inlet 61 of the through portion 6.

Figure 8B:
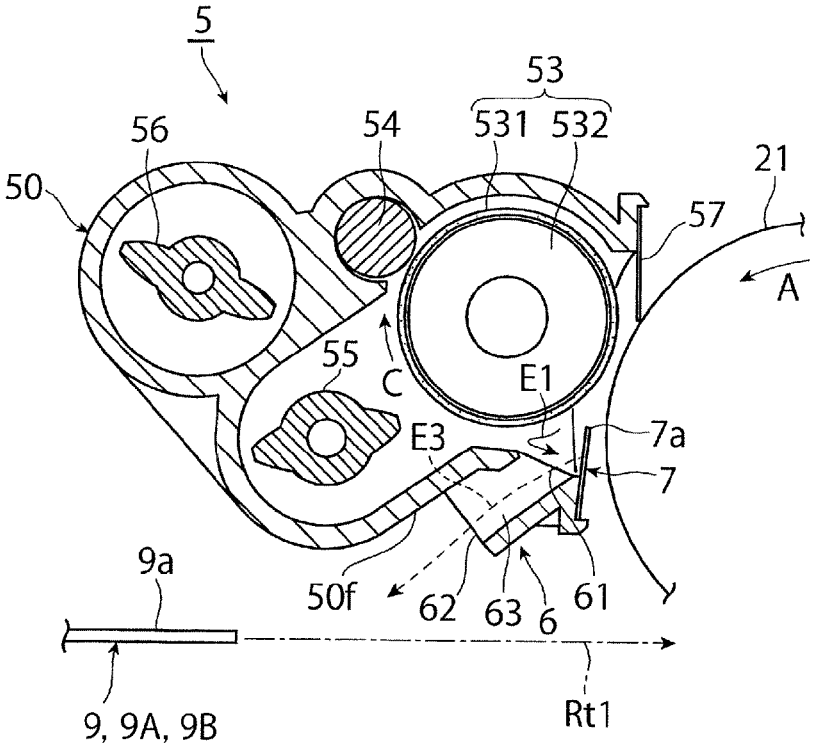
FIG. 8B is a schematic sectional view of a next state of the operation of this developing device.

However, as has been described, the airflow E (airflow E1) mostly flows in a direction so as to fold back instead of flowing to the inside of the housing 50 (FIG. 8B). There is a possibility that the flying developer 15 (actually, the toner) is borne by the airflow E1 flowing so as to fold back and discharged to the outside of the housing 50.

In order to address this, in the developing device 5, the directing member 7 is provided in addition to the through portion 6. Thus, as exemplified in FIG. 8B, the airflow E1 flowing so as to fold back instead of flowing to the inside of the housing 50 is brought into contact with the directing member 7 and directed so as to be introduced into the inlet 61 of the through portion 6. That is, in the developing device 5, the airflow E1 flowing so as to fold back becomes the airflow E3 introduced into the inlet 61 of the through portion 6 by being directed by the directing member 7.

At this time, the above-described airflow E2 that moves so as to directly enter the inlet 61 also exists in a region surrounded by the directing member 7, the developing roller 53, and the inlet 61 of the through portion 6. This suppresses flowing of the airflow E1 into a gap between the developing device 5 and the photoconductor drum 21 serving as an example of an outside of the housing 50 through a gap between the directing member 7 and the developing roller 53.

Specifically, a portion including the end portion 7*a* at the free end the directing member 7 does not shake even when the airflow E generated by the rotation of the developing roller 53 or the airflow E1 flowing so as to fold back is brought into contact with the directing member 7.

Thus, with the developing device 5, even when part of the developer 15 flies due to the airflow E1 flowing so as to fold back instead of flowing to the inside of the housing 50, dispersion of the flying developer 15 (actually, the toner) borne by the airflow E1 so as to be discharged to the outside of the housing 50 (such as a transfer section or the gap between the developing device 5 and the photoconductor drum 21) may be suppressed.

Furthermore, the airflow E3 introduced through the inlet 61 of the through portion 6 by being directed by the directing member 7 passes through the passage 63 and is discharged through the outlet 62 of the through portion 6 as exemplified in FIG. 8B.

In so doing, the toner of the developer 15 included in the airflow E3 is also mostly borne by the airflow E3 so as to be discharged through the outlet 62 of the through portion 6 while partly being attracted to and remaining in the passage 63.

In so doing, also, a very small amount of the toner having been discharged through the outlet 62 of the through portion 6 is discharged to the outside of the housing 50 of the developing device 5 (so as to temporarily move along the outer surface 50*f*) and drops downward.

In so doing, also, when the sheet 9 is transported through the supply transport path Rt1 disposed below the developing device 5, part of the toner discharged through the outlet 62 of the through portion 6 drops on and is attracted to a front side 9*a* of the sheet 9.

This generates a fog on the front side 9*a* of the sheet 9 with such a small amount of the toner that is difficult to be recognized by the naked eye. The toner discharged through the outlet 62 of the through portion 6 at this time is collected by the sheet 9 so as to be naturally transported to the outside of the housing 10 of the image forming apparatus 1 at last, not remaining in the housing 10.

In contrast, at the time when the sheet 9 is not transported through the supply transport path Rt1, the toner discharged through the outlet 62 of the through portion 6 is temporarily attracted to the transport guide member 13 (FIG. 2) on the supply transport path Rt1.

In this developing device 5, the airflow E1 that does not flow to the inside of the housing 50 out of the airflow E generated by the rotation of the developing roller 53 is introduced into the inlet 61 of the through portion 6. In so doing, as illustrated in FIG. 9, the airflow E1 is introduced such that (the amount of) the airflow E1 flowing through the openings 61A1, 61A2, 61A3 of the inlet 61, which are disposed in the central region 601 in the axial direction D of the developing roller 53 and the opening area S1 of which is relatively large, is larger than that flowing through the openings 61B1, 61B2 of the inlet 61, which are disposed in both the end regions 602, 603 in the axial direction D of the developing roller 53 and the opening area S2 of which is relatively small.

Figure 9:
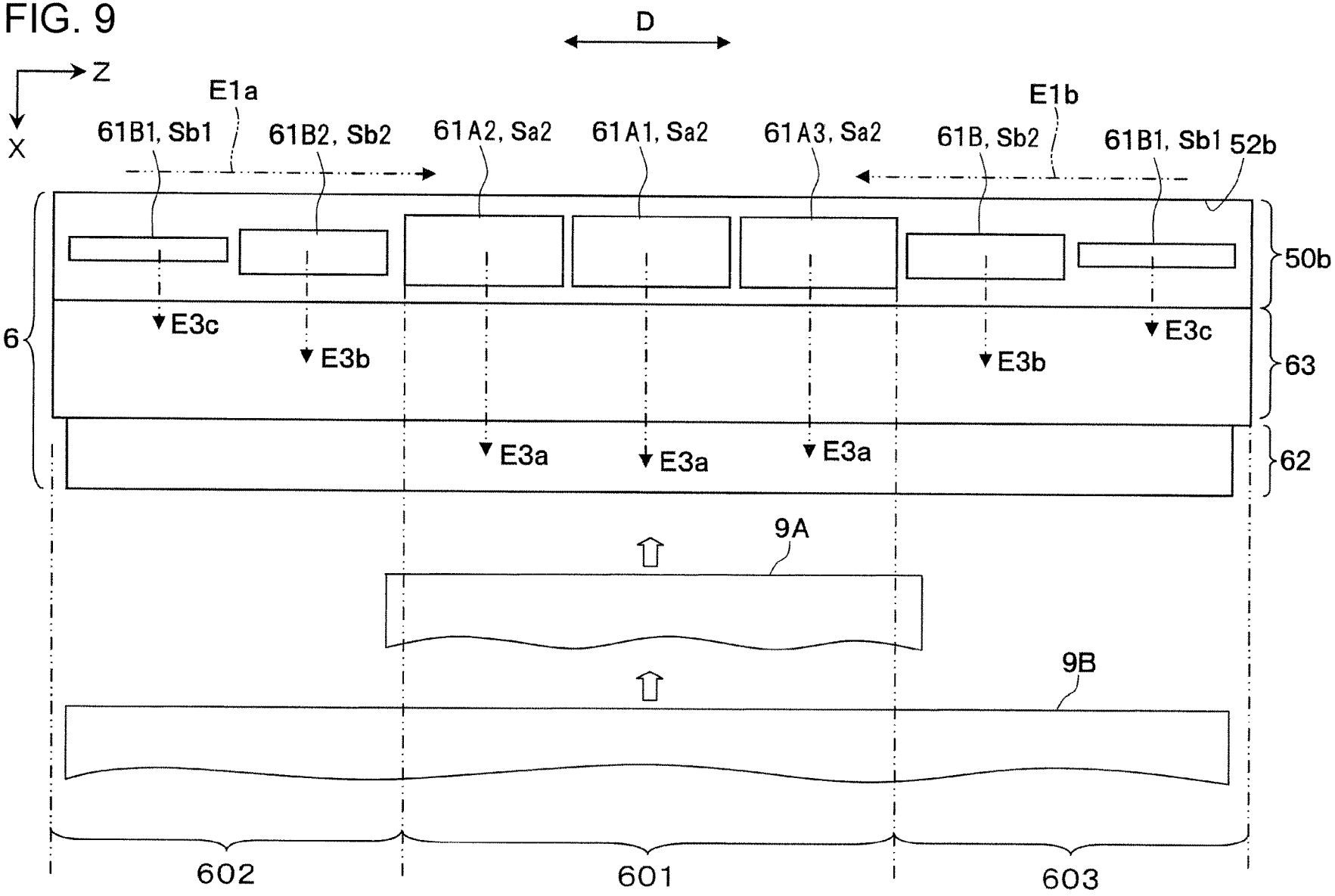
FIG. 9 is a conceptual view illustrating the relationship between a developed state of the through portion and a passing sheet of paper.

That is, as exemplified by two-dot chain line arrows E1*a*, E1*b* in FIG. 9, the airflow E1 flows while moving from both the end regions 602, 603 at which the openings 61B1, 61B2 of the inlet 61 having a relatively small opening area S2, and accordingly, having a small passing sectional area are disposed toward the central region 601 at which the openings 61A1, 61A2, 61A3 of the inlet 61 having a relatively large opening area S1 and accordingly, having a large passing sectional area are disposed.

As a result, the amount of an airflow E3*a* flowing through the openings 61A1, 61A2, 61A3 of the inlet 61 of the through portion 6 disposed in the central region 601 is larger than the amount of airflows E3*c*, E3*b* flowing through the openings 61B1, 61B2 of the inlet 61 of the through portion 6 disposed in both the end regions 602, 603. Specifically, the amount of the airflows E3*b* flowing through the openings 61B2 disposed in both the end regions 602, 603 is larger than the amount of the airflows E3*c* flowing through the openings 61B1 disposed in both the end regions 602, 603.

Accordingly, with the developing device 5, when the airflows (E2, E3) are introduced through the inlet 61 of the through portion 6, passing or remaining and existing of a relatively large amount (compared to that in the central region 601) of the developer 15 (toner) through or in both the end regions 602, 603 in the passage 63 of the through portion 6 may be suppressed.

Furthermore, in the image forming apparatus 1 including this developing device 5, as schematically illustrated in FIG. 9, the amount of the toner passing through the passage 63 of the through portion 6 of the developing device 5 and discharged through the outlet 62 of the through portion 6 of the developing device 5 may be larger in the central region 601 than in both the end regions 602, 603.

Thus, for example, even when images are continuously formed on sheets 9A having a relatively small sheet width for the transportation, a relatively large amount of the toner introduced through the inlet 61 of the through portion 6 of the developing device 5 by being borne by the airflow E1 passes through the central region 601 of the passage 63 of the through portion 6 and is discharged through the outlet 62. The toner having been discharged drops on the sheets 9A having a relatively small sheet width and is collected. Furthermore, remaining and existing, in both the end regions 602, 603 of the passage 63, of the toner introduced into the through portion 6 at this time may be suppressed.

Furthermore, even when an image is formed on a sheet 9B having a relatively large sheet width after images have been continuously formed on the sheets 9A having a relatively small sheet width, the toner introduced into the through portion 6 of the developing device 5 is discharged through the outlet 62 of the through portion 6, and then, much of this discharged toner may drop on a region at or near the center of the sheet 9B having a relatively large sheet width. Thus, the toner may be more reliably collected.

In this case, the toner remaining in both the end regions 602, 603 of the passage 63 of the through portion 6 when the images have been continuously formed on the sheets 9A having a relatively small sheet width does not necessarily drop so as to be attracted to both end portions (portions projecting in the width direction compared to the width of the sheets 9A) of the sheet 9B having a relatively large width. Thus, both the end portions of the sheet 9B are not necessarily smeared with the toner.

Second Exemplary Embodiment

Figure 10A:
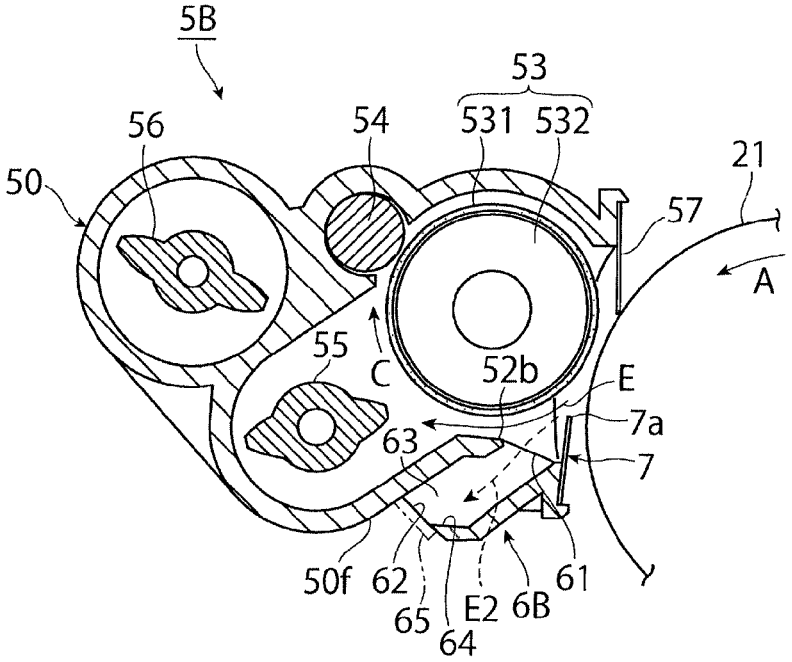
FIGS. 10A and 10B illustrate a developing device according to a second exemplary embodiment, and out of FIGS. 10A and 10B.
Figure 10B:
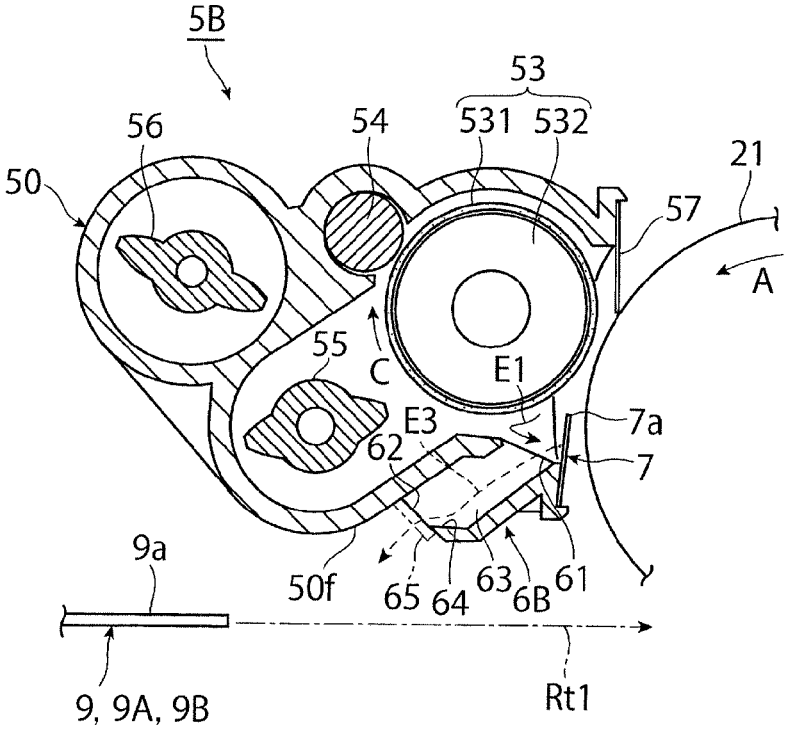

FIGS. 10A and 10B illustrate a developing device according to a second exemplary embodiment.

A developing device 5B according to the second exemplary embodiment has the same structure as that of the developing device 5 according to the first exemplary embodiment other than a change in through portion, that is, a through portion 6B is used for the developing device 5B. The through portion 6B has a bottom surface portion 64 that is bent toward (the outer surface 50*f* of) the housing 50 between the inlet 61 and the outlet 62 of the passage 63.

As illustrated in FIG. 10A, the through portion 6B has a bottom surface of the inner wall surface of the passage 63 facing the outer surface 50*f* of the housing 50. As part of this bottom surface, the through portion 6B has the bottom surface portion 64 bent toward the outer surface 50*f* of the housing 50 at a midway between the inlet 61 and the outlet 62.

The bottom surface portion 64 is bent midway so as to be flexed, for example, at an angle within a range of an obtuse angle relative to part of the bottom surface extending directly from the inlet 61 under the precondition that the dimension of the outlet 62 in the vertical direction is ensured. The bottom surface portion 64 that is bent midway may be bent so as to be curved.

As illustrated in FIG. 10B, in this developing device 5B, at least part of the airflow E3 introduced through the inlet 61 of the through portion 6B and flowing is brought into contact with the bottom surface portion 64 bent midway when passing through the passage 63, and then discharged through the outlet 62.

Thus, the toner of the developer 15 included in the airflow E3 is likely to be attracted to and remain in the bottom surface portion 64 of the passage 63 of the through portion 6B.

Accordingly, compared to the case where the through portion does not have the bottom surface portion 64 bent midway, this developing device 5B facilitates reduction of the amount of discharge, through the outlet 62, of the toner of the developer 15 remaining and existing at part of the passage 63 of the through portion 6B.

The toner discharged through the outlet 62 of the through portion 6B of the developing device 5B drops on and is attracted to the front side 9*a* of the sheet 9 passing through the supply transport path Rt1 at the time of, for example, the image formation. In the image forming apparatus 1 including this developing device 5B, the amount of the toner attracted to the front side 9*a* of the sheet 9 at this time is reduced compared to the case where the developing device having the through portion without the bottom surface portion 64 bent midway is provided.

As indicated by a two-dot chain line in FIGS. 10A and 10B, the developing device 5B may include a mesh member 65 at the outlet 62 of the through portion 6B.

The mesh member 65 has holes (vents) having such a size that allow the air of the airflow E3 and the toner that is included in the airflow E3 and not flocculated to pass the holes. The mesh member 65 is provided so as to close the outlet 62. As the mesh member 65, for example, a member such as a nonwoven fabric is used.

With the developing device 5B having the through portion 6B provided with the above-described mesh member 65, the toner of the developer 15 remaining and existing in the passage 63 of the through portion 6B is discharged while being adjusted to be averaged by passing through the mesh member 65 when discharged through the outlet 62.

For example, when the developing device 5B alone or the developing device 5B together with another element (device) of the image making device 2 is detachable from the housing 10 of the image forming apparatus 1, the developing device 5B may be subjected to external shocks due to contact or the vibration of the developing device 5B during detachment/attachment. However, even in such a case, the above-described structure with the mesh member 65 may reduce the likelihood of the toner of the developer 15 that remains and exists in the passage 63 of the through portion 6B of the developing device 5B being discharged and dropping (such as dripping) through the outlet 62 in a state in which the toner is flocculated into blocks.

This mesh member 65 is also able to be provided at the outlet 62 of the through portion 6 of the developing device 5 according to the first exemplary embodiment.

Also with the developing device 5 provided with the mesh member 65 as described above, operating features similar to the case with the developing device 5B may be obtained.

Third Exemplary Embodiment

Figure 11:
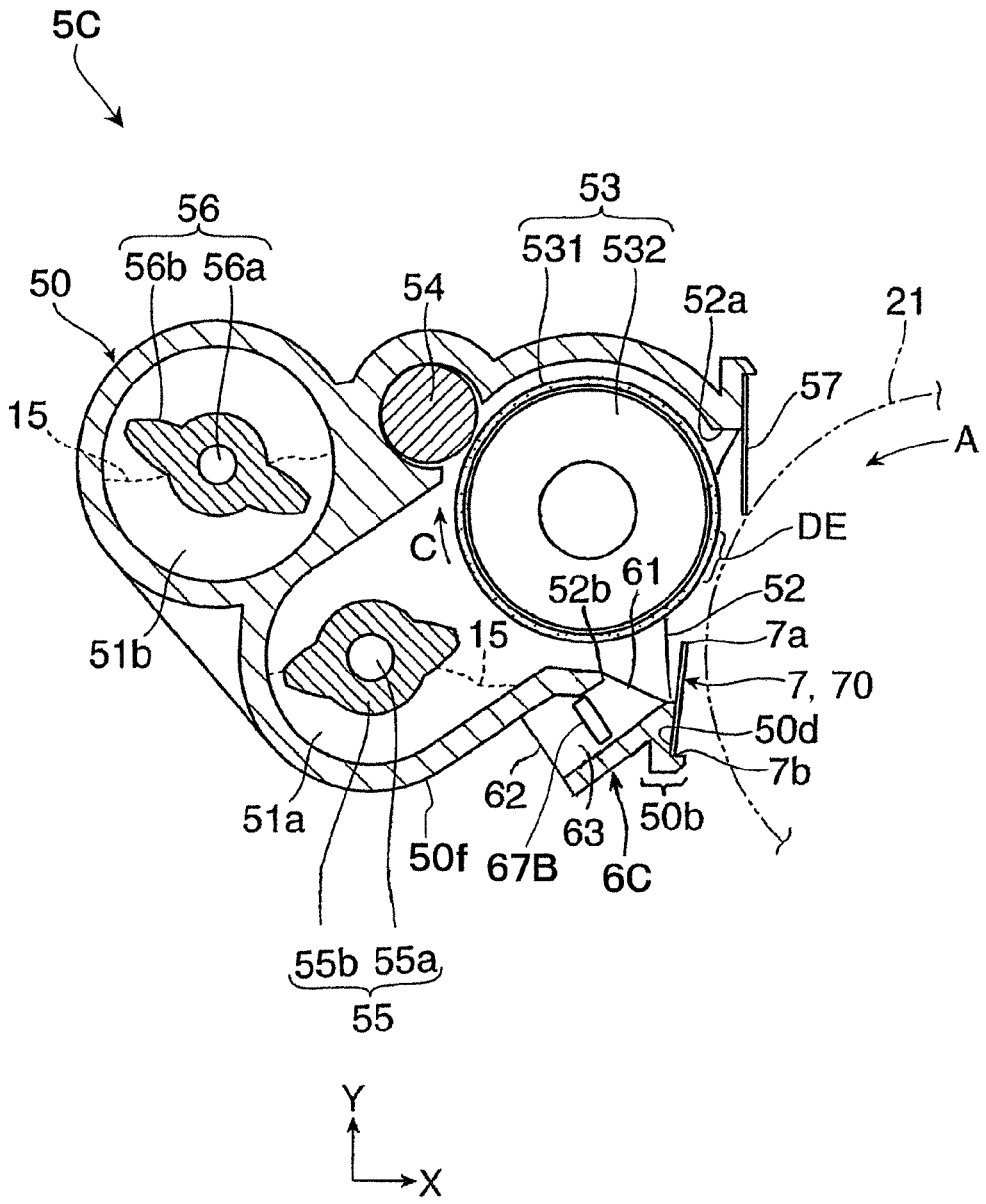
FIG. 11 is a schematic sectional view of the structure of a developing device according to a third exemplary embodiment.
Figure 12:
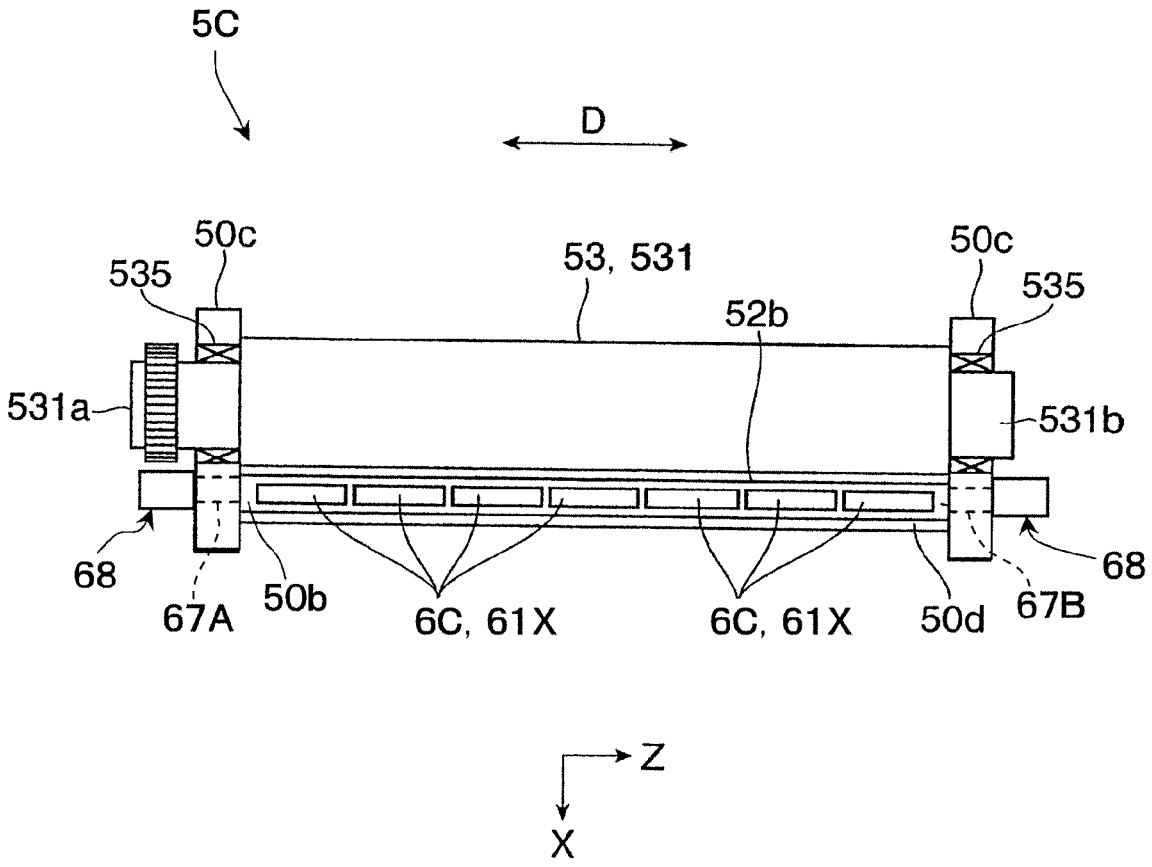
FIG. 12 is an overview of part of the developing device (with the directing device omitted) illustrated in FIG. 11.
Figure 13:
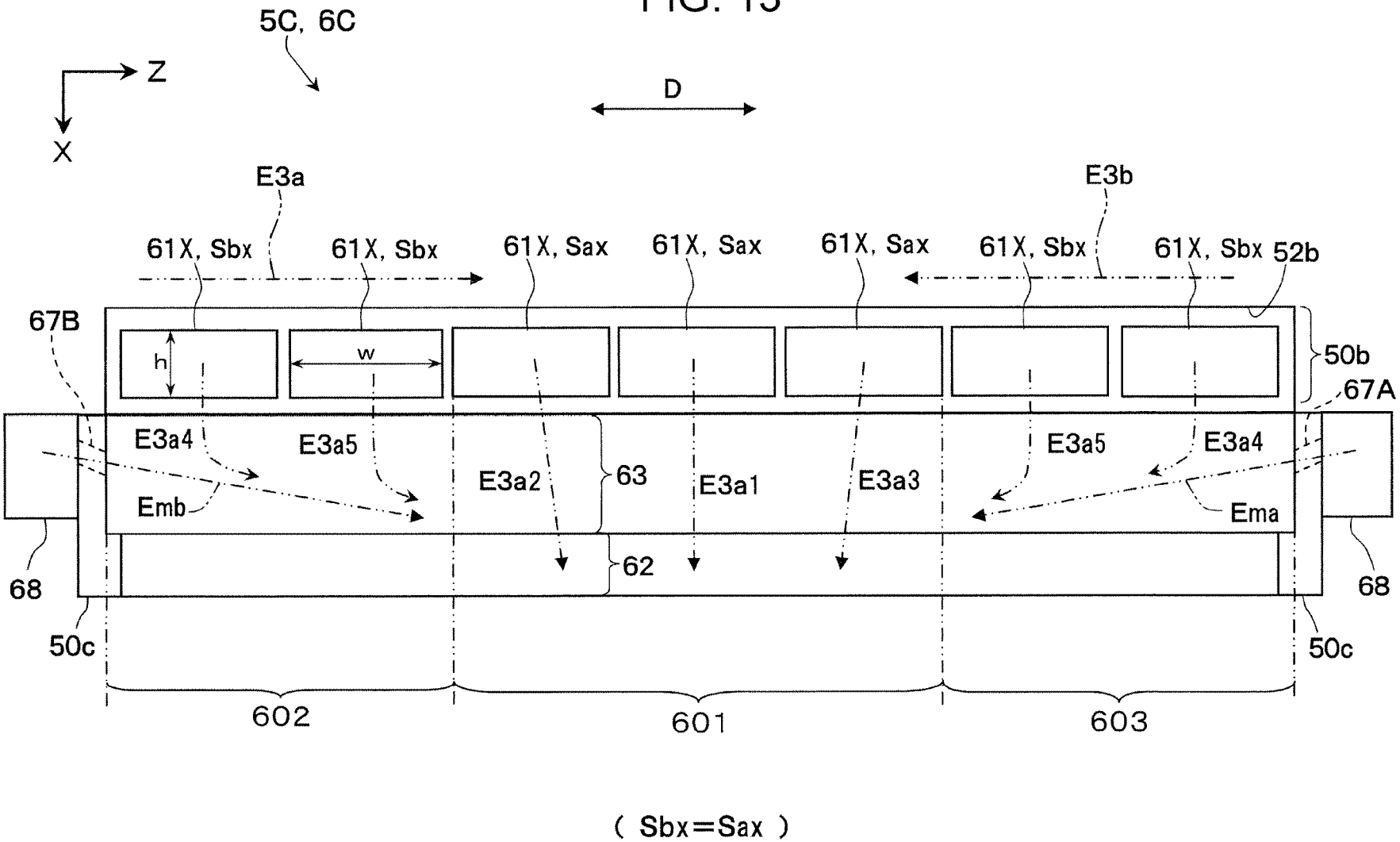
FIG. 13 is a conceptual view of the structure and an operating state of a through portion of the developing device illustrated in FIG. 11 with the through portion developed.

FIGS. 11 to 13 illustrate a developing device according to a third exemplary embodiment.

A developing device 5C according to the third exemplary embodiment is changed from the developing device 5 according to the first exemplary embodiment as follows. That is, as the through portion, a through portion 6C is used. The inlet 61 of the through portion 6C has a plurality of openings having the same opening area. In addition, side openings 67 provided in side surfaces, respectively, at both ends of the passage 63 and air supply devices 68 that supply air from the respective side openings 67 toward the center of the passage 63 are provided for the through portion 6C. Other than these, the developing device 5C according to the third exemplary embodiment has the same structure as that of the developing device 5 according to the first exemplary embodiment.

As illustrated in FIG. 13, the through portion 6C of the developing device 5C has the inlet 61 having seven openings 61X of the same rectangular opening shape. Thus, an opening area Sax of each of the openings 61X of portions disposed in the central region 601 in the axial direction D of the inlet 61 and an opening area Sbx of each of the openings 61X disposed in both the end regions 602, 603 in the axial direction D of the inlet 61 are the same.

Accordingly, in the through portion 6C, the size (area) of the opening area S1 of portions of the inlet 61 disposed in the central region 601 in the axial direction D is the same as the size (area) of the opening area S2 of portions of the inlet 61 disposed in both the end regions 602, 603 in the axial direction D.

Furthermore, as illustrated in FIGS. 11 to 13, this through portion 6C has side openings 67A, 67B in the side surfaces at both the ends of the passage 63 (side wall surfaces of the housing 50) in the axial direction D of the developing roller 53. Furthermore, as illustrated in FIGS. 12 and 13, the through portion 6C is provided with the air supply devices 68 that respectively supply air Em flowing from the side openings 67A, 67B of the passage 63 toward the center of the passage 63 in the axial direction D.

The side openings 67A, 67B are through holes that are, for example, openings having a vertically long rectangular opening shape as illustrated in FIG. 12.

The side openings 67A, 67B according to the third exemplary embodiment are passages obliquely penetrating through the housing 50 toward the outlet 62 from the outside toward the inside of the housing 50 so as to allow, for example, as illustrated in FIG. 13, the air Em to be supplied therethrough such that the air Em moves in the oblique direction so as to approach the outlet 62 as the air Em moves toward the center of the passage 63 of the through portion 6C in the axial direction D.

The air supply devices 68 include introduction tubes disposed so as to introduce the air as the air Em into the passage 63 of the through portion 6C by utilizing part of an airflow naturally or artificially generated in the housing 10 of the image forming apparatus 1.

The air supply devices 68 may have another structure than the above-described structure. For example, the air supply devices 68 may actively supply the air Em by using dedicated fans and blower tubes.

In the developing device 5C including such a through portion 6C, the airflow E1 that does not flow to the inside of the housing 50 out of the airflow E generated by the rotation of the developing roller 53 is introduced into the inlet 61 of the through portion 6C. In so doing, as illustrated in FIG. 13, the airflow E1 is introduced such that the amounts of the airflow E1 flowing through the seven openings 61X of the inlet 61 having the same opening shape and the same area is substantially the same.

Meanwhile, with the through portion 6C, as illustrated in FIG. 13, air Ema, Emb from the air supply devices 68 is supplied into the passage 63 through the side openings 67A, 67B, respectively. The air Ema, Emb at this time is, as exemplified by two-dot chain line arrows Ema, Emb in FIG. 13, supplied to move in the oblique direction so as to approach the outlet 62 as the air Ema, Emb moves toward the center in the axial direction D of the passage 63.

As a result, the airflow E3 introduced through the seven openings 61X of the inlet 61 of the through portion 6C flows through the passage 63 as follows.

First, as illustrated in FIG. 13, airflows E3*a*4, E3*a*5 flowing through the two openings 61X disposed in the end region 602 of the passage 63 and the two openings 61X disposed in the end region 603 of the passage 63 are subjected to relatively large flowing forces (wind forces) of the air Emb, Ema supplied through the side openings 67B, 67A, thereby flowing so as to move in a flowing paths bent toward the central region 601 of the passage 63.

Meanwhile, airflows E3*a*1, E3*a*2, E3*a*3 flowing through the three openings 61X disposed in the central region 601 of the passage 63 are subjected to the relatively small flowing forces (wind forces) of the air Ema, Emb, thereby flowing substantially straightly through the central region 601 of the passage 63 substantially without a change in flowing paths. Out of these, the airflows E3*a*2, E3*a*3 flowing through the openings 61X disposed close to the respective end regions 602, 603 in the central region 601 of the passage 63 are slightly subjected to the flowing forces (wind forces) of the air Emb, Ema, thereby flowing so as to be slightly bent toward the central region 601 of the passage 63 due to changes in flowing paths.

That is, as exemplified by two-dot chain line arrows E3*a*, E3*b* in FIG. 13, the airflow E1 introduced through the inlet 61 of the through portion 6C flows, when passing through the passage 63 of the through portion 6C, so as to be gathered (be concentrated) from the both the end regions 602, 603 toward the central region 601 in the passage 63 by the action of the air Emb, Ema.

As a result, regarding the amount the airflow during passing through the passage 63 of the through portion 6C and discharge through the outlet 62 of the through portion 6C, the amount of the airflow flowing through the central region 601 of the passage 63 is larger than the amount of the airflow flowing through both the end regions 602, 603 of the passage 63.

Accordingly, also with the developing device 5C, when the air flows (E2, E3) are introduced through the inlet 61 of the through portion 6C, passing or remaining and existing of a relatively large amount (compared to that in the central region 601) of the developer 15 (toner) through or in both the end regions 602, 603 in the passage 63 of the through portion 6C may be suppressed.

Furthermore, in the image forming apparatus 1 including this developing device 5C, almost similarly to the case of the image forming apparatus 1 including the developing device 5 according to the first exemplary embodiment, the amount of the toner passing through the passage 63 of the through portion 6C of the developing device 5C and discharged through the outlet 62 of the through portion 6C of the developing device 5C may be larger in the central region 601 than in both the end regions 602, 603.

Thus, almost similarly to the case of the image forming apparatus 1 including the developing device 5 according to the first exemplary embodiment (see FIG. 9), for example, even when images are continuously formed on the sheets 9A having a relatively small sheet width for the transportation, a relatively large amount of the toner introduced through the inlet 61 of the through portion 6C of the developing device 5C by being borne by the air flow E1 passes through the central region 601 of the passage 63 of the through portion 6C and is discharged through the outlet 62. The toner having been discharged drops on the sheets 9A having a relatively small sheet width and is collected. Furthermore, remaining and existing, in both the end regions 602, 603 of the passage 63, of the toner introduced into the through portion 6C at this time may be suppressed.

Furthermore, even when an image is formed on the sheet 9B having a relatively large sheet width after images have been continuously formed on the sheets 9A having a relatively small sheet width, the toner introduced into the through portion 6C of the developing device 5C is discharged through the outlet 62 of the through portion 6C, and then, much of this discharged toner may drop on a region at or near the center of the sheet 9B having a relatively large sheet width. Thus, the toner may be more reliably collected.

In this case, the toner remaining in both the end regions 602, 603 of the passage 63 of the through portion 6C when the images have been continuously formed on the sheets 9A having a relatively small sheet width does not necessarily drop so as to be attracted to both the end portions of the sheet 9B having a relatively large width. Thus, both the end portions of the sheet 9B are not necessarily smeared with the toner.

Fourth Exemplary Embodiment

Figure 14:
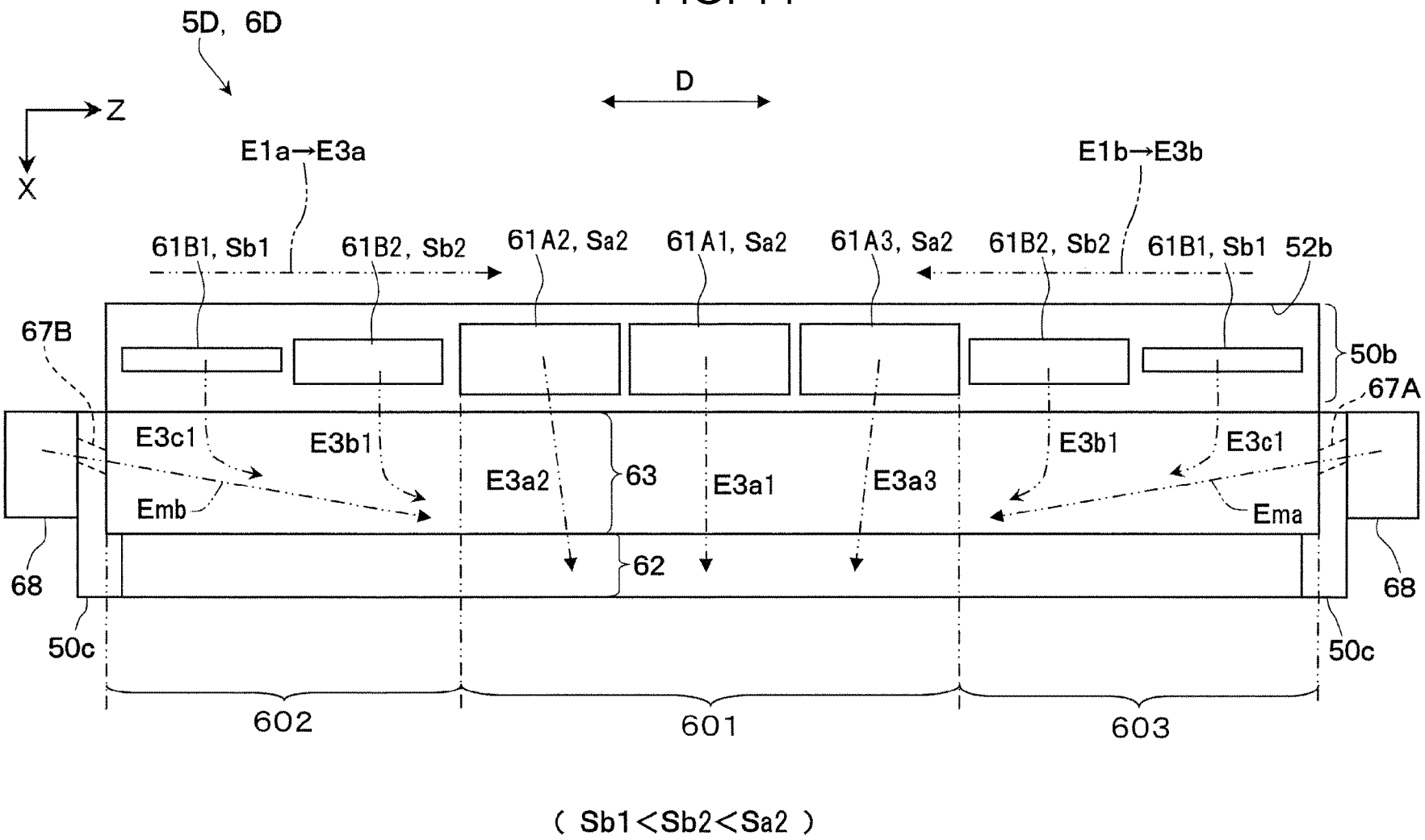
FIG. 14 is a conceptual view of the structure and an operating state of a through portion of a developing device according to a fourth exemplary embodiment with the through portion developed.

FIG. 14 illustrates part of a developing device according to a fourth exemplary embodiment.

A developing device 5D according to the fourth exemplary embodiment is changed from the developing device 5 according to the first exemplary embodiment as follows. That is, as the through portion, a through portion 6D is used. The through portion 6D is provided with the side openings 67 in the side surfaces, respectively, at both the ends of the passage 63 and the air supply devices 68 that supply the air from the respective side openings 67 toward the center of the passage 63. Other than these, the developing device 5D according to the fourth exemplary embodiment has the same structure as that of the developing device 5 according to the first exemplary embodiment.

It is able to be described that the developing device 5D has the same structure as that of the developing device 5C according to the third exemplary embodiment other than that the developing device 5D is changed from the developing device 5C by using, as the through portion, a structure in which the relationships between the opening areas are similar to or the same as those of the inlet 61 according to the first exemplary embodiment.

The inlet 61 of the through portion 6D has the same structure as that of the inlet 61 according to the first exemplary embodiment (FIG. 5).

Furthermore, the side openings 67A, 67B and the air supply devices 68 at the through portion 6D have the same structures as those of the side openings 67A, 67B and the air supply devices 68 according to the third exemplary embodiment (FIGS. 11 to 13).

In the developing device 5D having such a through portion 6D, the airflow E1 that does not flow to the inside of the housing 50 out of the airflow E generated by the rotation of the developing roller 53 is introduced into the inlet 61 of the through portion 6D. In so doing, the airflow E1 is introduced such that (the amount of) the airflow E1 flowing through the openings 61A1, 61A2, 61A3 of the inlet 61, which are disposed in the central region 601 in the axial direction D of the developing roller 53 and the opening area S1 of which is relatively large, is larger than that flowing through the openings 61B1, 61B2 of the inlet 61, which are disposed in both the end regions 602, 603 in the axial direction D of the developing roller 53 and the opening area S2 of which is relatively small (see FIG. 9).

Meanwhile, in the through portion 6D at this time, as illustrated in FIG. 14, the air Ema, Emb from the air supply devices 68 is supplied into the passage 63 through the side openings 67A, 67B, respectively. The air Ema, Emb at this time is, as exemplified by two-dot chain line arrows Ema, Emb in FIG. 14, supplied to move in the oblique direction so as to approach the outlet 62 as the air Ema, Emb moves toward the center in the axial direction D of the passage 63.

As a result, the airflow E3 introduced through the seven openings 61A1, 61A2, 61A3, 61B1, 61B2, 61B1, 61B2 of the inlet 61 of the through portion 6D flows through the passage 63 as follows.

First, as illustrated in FIG. 14, airflows E3*c* 1, E3*b*1 of relatively small air flow amounts and flowing through the two openings 61B1, 61B2 disposed in the end region 602 of the passage 63 and the two openings 61B1, 61B2 disposed in the end region 603 of the passage 63 are subjected to relatively large flowing forces (wind forces) of the air Emb, Ema supplied through the side openings 67B, 67A, thereby flowing so as to move in a flowing paths bent toward the central region 601 of the passage 63.

Meanwhile, airflows E3*a*1, E3*a*2, E3*a*3 flowing through the three openings 61A1, 61A2, 61A3 disposed in the central region 601 of the passage 63 are subjected to the relatively small flowing forces of the air Ema, Emb, thereby flowing substantially straightly through the central region 601 of the passage 63 substantially without a change in flowing paths. Out of these, the airflows E3*a*2, E3*a*3 flowing through the openings 61A2, 61A3 disposed close to the respective end regions 602, 603 in the central region 601 of the passage 63 are slightly subjected to the flowing forces of the air Emb, Ema, thereby flowing so as to be slightly bent toward the central region 601 of the passage 63 due to changes in flowing paths.

That is, as exemplified by two-dot chain line arrows E1*a*, E1*b* in FIG. 14, the airflow E1 introduced through the inlet 61 of the through portion 6D flows while moving from both the end regions 602, 603 at which the openings 61B1, 61B2 of the inlet 61 having a relatively small opening area S2, and accordingly, having a small passing sectional area are disposed toward the central region 601 at which the openings 61A1, 61A2, 61A3 of the inlet 61 having a relatively large opening area S1, and accordingly, having a large passing sectional area are disposed.

Furthermore, as exemplified by two-dot chain line arrows E3*a*, E3*b* in FIG. 14, the airflow E1 having been introduced through the inlet 61 of the through portion 6D flows, when passing through the passage 63 of the through portion 6D, so as to be gathered from the both the end regions 602, 603 toward the central region 601 in the passage 63 by the action of the air Emb, Ema.

As a result, the amount of an airflow E3*a* flowing through the openings 61A1, 61A2, 61A3 of the inlet 61 of the through portion 6D disposed in the central region 601 is larger than the amount of airflows E3*c*, E3*b* flowing through the openings 61B1, 61B2 of the inlet 61 of the through portion 6D disposed in both the end regions 602, 603. Furthermore, regarding the amount the airflow during passing through the passage 63 of the through portion 6D and discharge through the outlet 62 of the through portion 6D, the amount of the airflow flowing through the central region 601 of the passage 63 is larger than the amount of the airflow flowing through both the end regions 602, 603 of the passage 63.

Accordingly, with the developing device 5D, when the air flows (E2, E3) are introduced through the inlet 61 of the through portion 6D, passing or remaining and existing of a relatively large amount (compared to that in the central region 601) of the developer 15 (toner) through or in both the end regions 602, 603 in the passage 63 of the through portion 6D may be more reliably suppressed than with the developing devices 5, 5C.

Furthermore, in the image forming apparatus 1 including this developing device 5D, almost similarly to the case of the image forming apparatus 1 including the developing device 5 according to the first exemplary embodiment or the image forming apparatus 1 including the developing device 5C according to the third exemplary embodiment, it may be more reliably ensured that the amount of the toner passing through the passage 63 of the through portion 6D of the developing device 5D and discharged through the outlet 62 of the through portion 6D of the developing device 5D is larger in the central region 601 than that in both the end regions 602, 603.

Variations

For the first, second, and fourth exemplary embodiments, instead of the corresponding (inlets 61) of the through portions 6, 6B, 6D of the developing devices 5, 5B, 5D, for example, any of through portions 6E, 6F, 6G, 6H having respective inlets of the following varied structures may be used.

Figure 15:
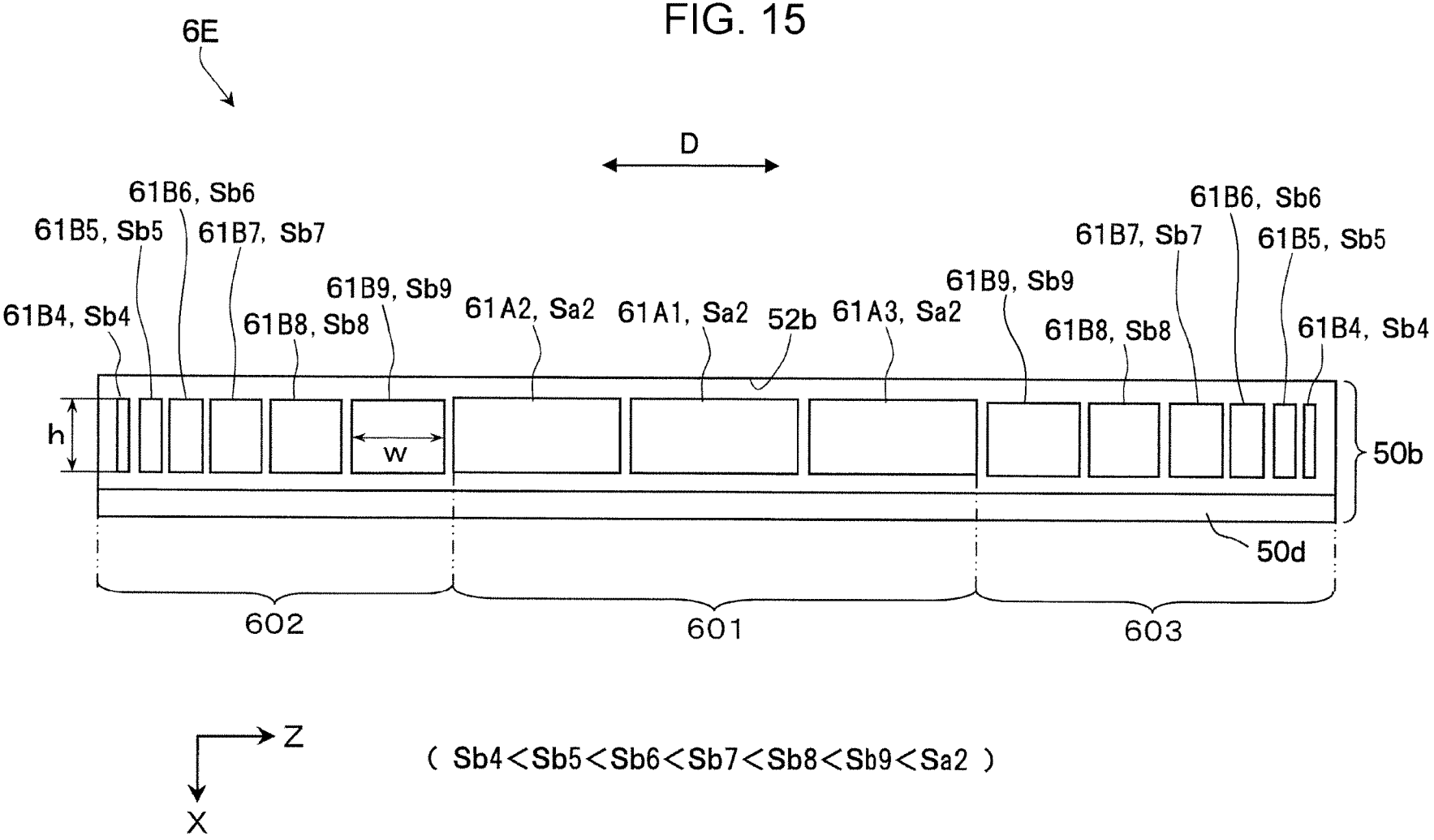
FIG. 15 is an overview of another example of the structure of the inlet of the through portion.

The through portion 6E exemplified in FIG. 15 has the inlet 61 having the total of 15 divided openings as follows: six openings 61B4, 61B5, 61B6, 61B7, 61B8, 61B9 that have the same height h and rectangular opening shapes and that is disposed in each of the end regions 602, 603; and three openings 61A1, 61A2, 61A3 that have a height h being the same as the height h of the six openings and the same rectangular opening shape and that is disposed in the central region 601.

Out of these, widths w of the six openings 61B4, 61B5, 61B6, 61B7, 61B8, 61B9 disposed in each of the end regions 602, 603 gradually increase in this order. Opening areas Sb4, Sb5, Sb6, Sb6, Sb7, Sb8, Sb9 of these six openings also increase in this order because the six openings have the same height h.

The following relationship is established in the inlet 61 of through portion 6E: the opening area S1 that is the total of the opening areas Sa2, Sa2, Sa2 (Sa2+Sa2+Sa2) of the three same openings 61A1, 61A2, 61A3 disposed in the central region 601 is larger than the opening area S2 that is double the total of the opening areas Sb4, Sb5, Sb6, Sb7, Sb8, Sb9 ((Sb4+Sb5+Sb6+Sb7+Sb8+Sb9)×2) of the six openings 61B4, 61B5, 61B6, 61B7, 61B8, 61B9 disposed in each of the end regions 602, 603.

Figure 16:
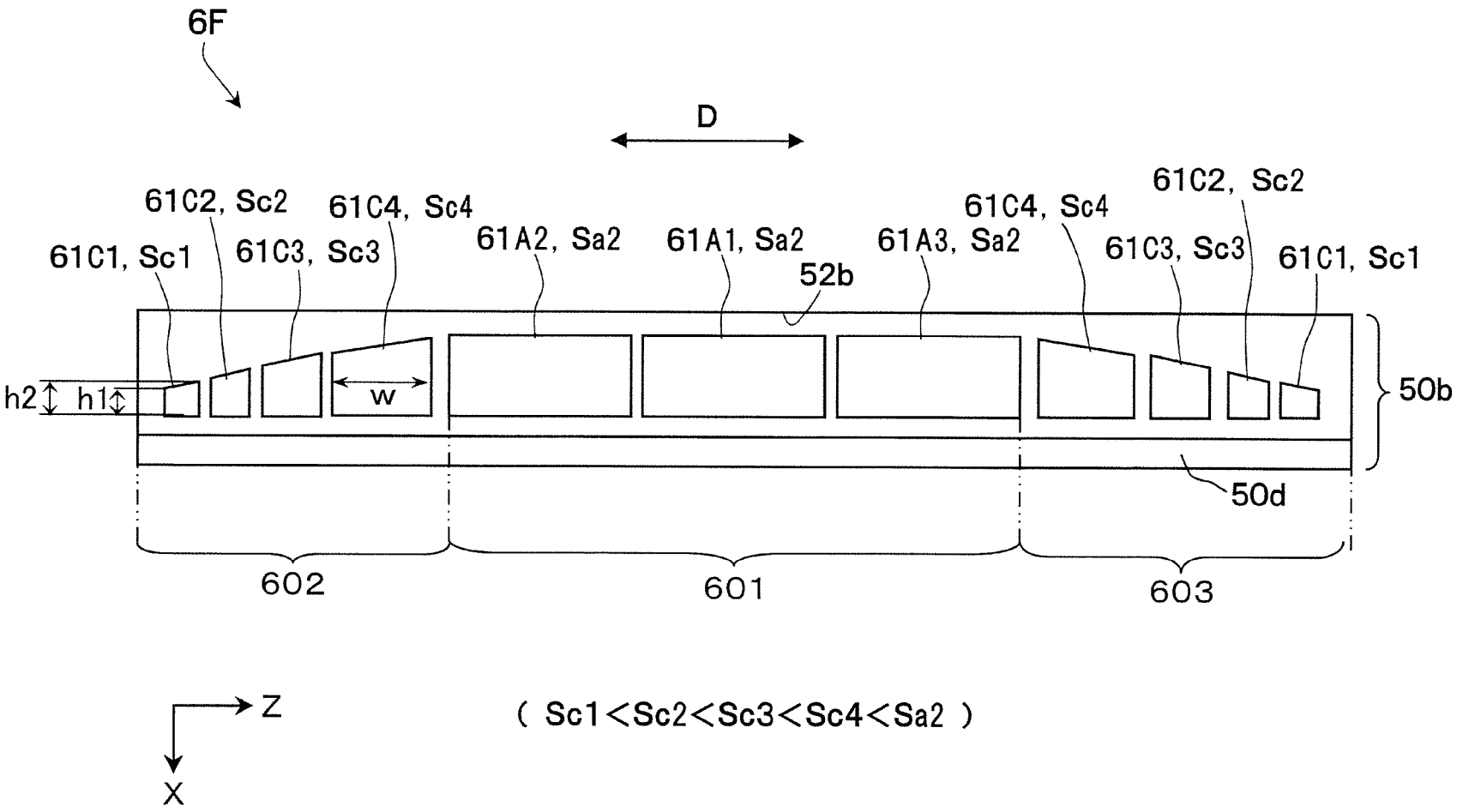
FIG. 16 is an overview of yet another example of the structure of the inlet of the through portion.

The through portion 6F exemplified in FIG. 16 has the inlet 61 having the total of 11 divided openings as follows: four openings 61C1, 61C2, 61C3, 61C4 the opening shapes of which are trapezoidal shapes turned sideways and which are disposed in each of the end regions 602, 603; and three openings 61A1, 61A2, 61A3 that have the same height h and the same rectangular opening shape and that is disposed in the central region 601.

Out of these, widths w of the four openings 61C1, 61C2, 61C3, 61C4 disposed in each the end regions 602, 603 gradually increase in this order. Furthermore, each of the four openings 61C1, 61C2, 61C3, 61C4 has left and right heights h1, h2 different from each other, and the heights h2 of the openings 61C1, 61C2, 61C3 are respectively the same as the heights h1 of the adjacent openings 61C2, 61C3, 61C4. Thus, the left and right heights h1, h2 of the openings 61C1, 61C2, 61C3, 61C4 gradually increase in this order. Lower sides of the four openings 61C1, 61C2, 61C3, 61C4 are at the same level and coincident with a line extending, in the axial direction D, through lower sides of the three same openings 61A1, 61A2, 61A3 disposed in the central region 601. In contrast, upper sides of the four openings 61C1, 61C2, 61C3, 61C4 are inclined such that the level of the upper sides gradually increases from the left or right end toward the central region 601.

The following relationship is established in the inlet 61 of the through portion 6F: the opening area S1 that is the total of the opening areas Sa2, Sa2, Sa2 (Sa2+Sa2+Sa2) of the three same openings 61A1, 61A2, 61A3 disposed in the central region 601 is larger than the opening area S2 that is double the total of opening areas Sc1, Sc2, Sc3, Sc4 ((Sc1+Sc2+Sc3+Sc4)×2) of the four openings 61C1, 61C2, 61C3, 61C4, disposed in each of the end regions 602, 603.

In particular, the opening areas Sc1, Sc2, Sc3, Sc4 of the four openings 61C1, 61C2, 61C3, 61C4 of the inlet 61 of the through portion 6F disposed in each of the end regions 602, 603 increase toward the central region 601. Thus, the differences in amount of the toner of the developer 15 passing through or remaining and existing in both the end regions 602, 603 of the passage 63 of the through portion 6F may be smoothly reduced with less stepwise reductions.

It is also possible to make the opening areas Sa2, Sa2, Sa2 of the three same openings 61A1, 61A2, 61A3 of the inlet 61 of the through portion 6F disposed in the central region 601 increase toward the central position of the central region 601 in the axial direction D. With the through portion 6F having such a structure, the differences in amount of the toner of the developer 15 passing through or remaining and existing in the central region 601 of the passage 63 of the through portion 6F in addition to both the end regions 602, 603 of the passage 63 may be smoothly reduced with less stepwise reductions.

Figure 17:
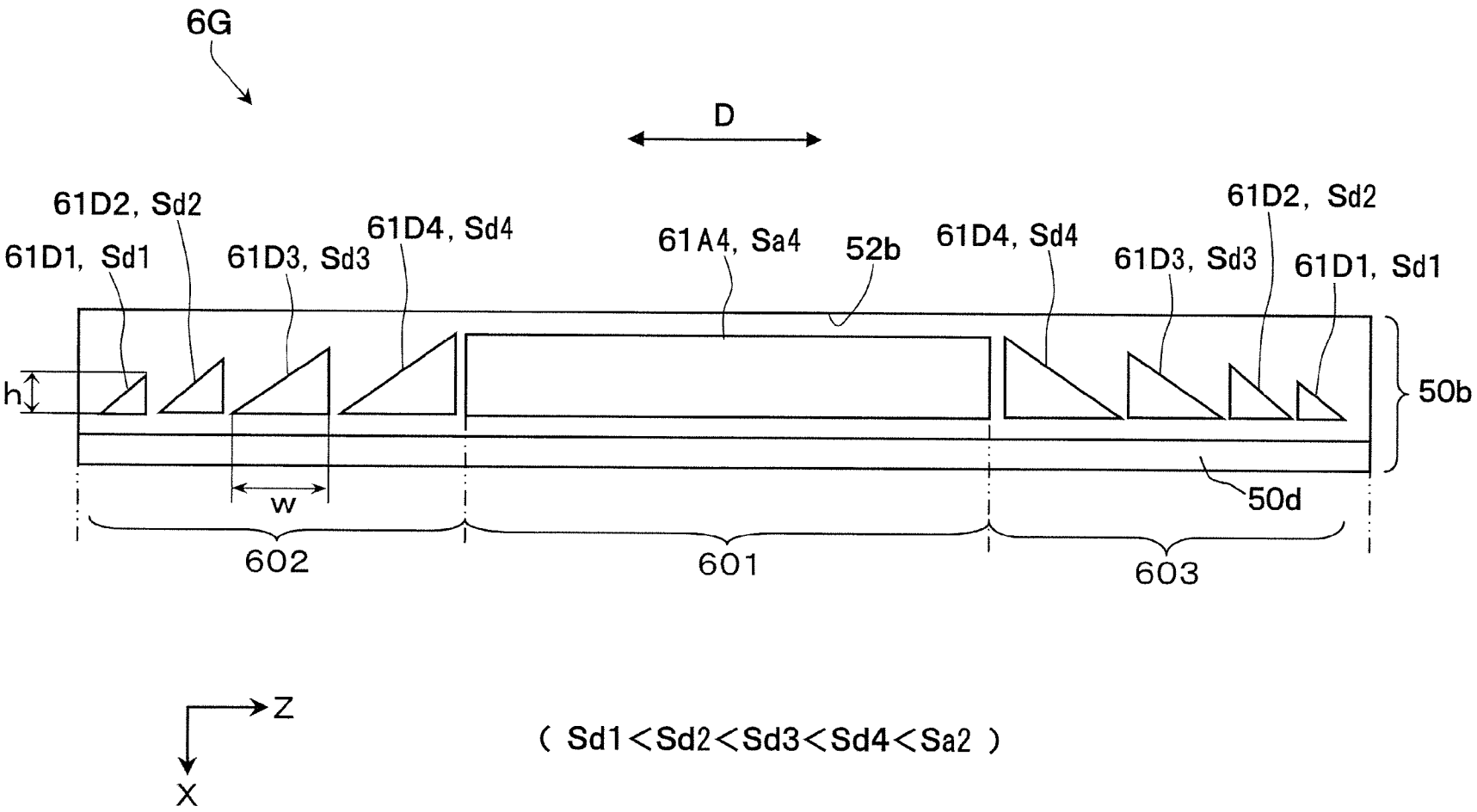
FIG. 17 is an overview of yet another example of the structure of the inlet of the through portion.

The through portion 6G exemplified in FIG. 17 has the inlet 61 having the total of 9 divided openings as follows: four openings 61D1, 61D2, 61D3, 61D4 that have right triangular opening shapes and that are disposed in each of the end regions 602, 603; and a single opening 61A4 that has a rectangular opening shape and that is disposed in the central region 601.

Out of these, widths w of the four openings 61D1, 61D2, 61D3, 61D4 disposed in each the end regions 602, 603 gradually increase in this order. Furthermore, heights h of the four openings 61D1, 61D2, 61D3, 61D4 also gradually increase in this order. Lower sides of the four openings 61D1, 61D2, 61D3, 61D4 are at the same level and coincident with a line extending, in the axial direction D, through a lower side of the single opening 61A4 disposed in the central region 601. In contrast, hypotenuses of the four openings 61D1, 61D2, 61D3, 61D4 gradually increase in length from the left or right end toward the central region 601.

The following relationship is established in the inlet 61 of through portion 6G: the opening area S1 that is an opening area Sa4 of the single opening 61A4 disposed in the central region 601 is larger than the opening area S2 that is double the total of opening areas Sd1, Sd2, Sd3, Sd4 ((Sd1+Sd2+Sd3+Sd4)×2) of the four openings 61D1, 61D2, 61D3, 61D4 disposed in each of the end regions 602, 603.

Figure 18:
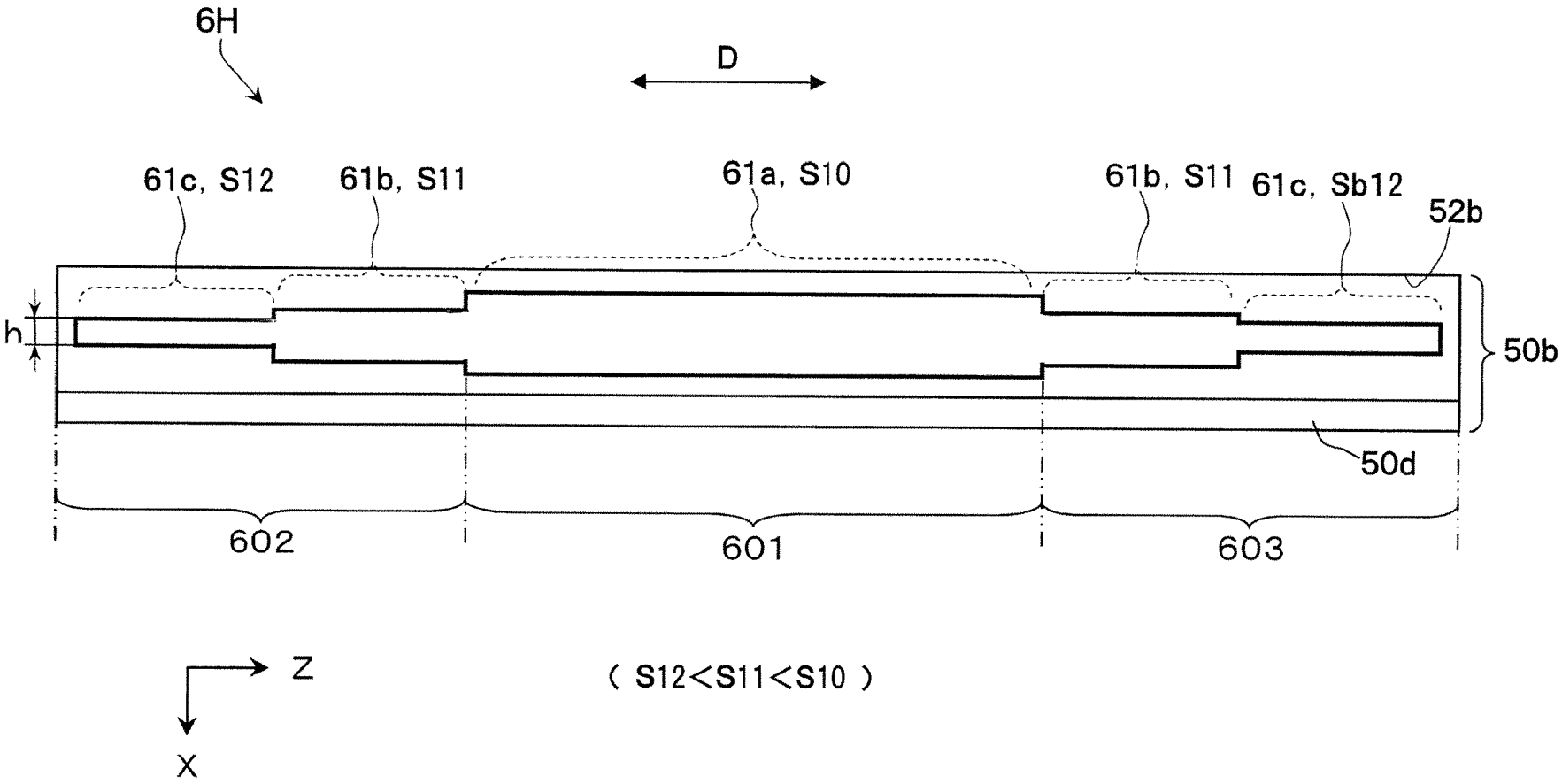
FIG. 18 is an overview of the other structure of the inlet of the through portion.

The through portion 6H exemplified in FIG. 18 has the inlet 61 having a single continual opening the opening shape (area) of which gradually increases from both the end regions 602, 603 toward the central region 601.

That is, the inlet 61 having this single continual opening includes a single inlet central portion 61*a* that has a largest rectangular opening shape and that is disposed in the central region 601 and two inlet end portions 61*b*, 61*c* that have an elongated rectangular shape the height of which gradually reduces and that is disposed in each of the end regions 602, 603. The two inlet end portions 61*b*, 61*c* has the same width w and the height that is smaller than a height h of the inlet central portion 61*a* and further reduces toward the end. Meanwhile, the single inlet central portion 61*a* has the height h and a width w that are respectively larger than a height h and the width w of the two inlet end portions 61*b*, 61*c*.

The following relationship is established in the inlet 61 of through portion 6H: the opening area S1 that is an opening area S10 of the inlet central portion 61*a* disposed in the central region 601 is larger than the opening area S2 that is double the total of opening areas S11, S12 ((S11+S12)×2) of the two inlet end portions 61*b*, 61*c* disposed in each of the end regions 602, 603.

Furthermore, the inlet 61 having a plurality of divided openings of any of the through portions 6, 6B, 6D according to the first, second, and fourth exemplary embodiments is able to have a structure having a single continual inlet similarly to that of the through portion 6H exemplified in FIG. 18.

Other than the above description, the inlet 61 of the through portion 6 or the like having the plurality of divided openings may have the following structures.

Examples of the other inlet 61 include, for example, an inlet which have openings the shape of which is other than the above-described shapes such as a circular or elliptical shape arranged in a single or a plurality of rows and in which the opening area S1 that is the total of opening areas of all the openings disposed in the central region 601 is larger than the opening area S2 that is the total of opening areas of all the openings disposed in both the end regions 602, 603.

The opening area S1 and the opening area S2 of the inlet 61 are adjusted by changing the conditions relating to the dimensions such as heights h, widths w, lengths of sides, and states of curves of the openings of the inlet 61.

As the mesh member 65 provided at the outlet 62 of the through portion 6B according to the second exemplary embodiment, a member having holes of a uniform size (roughness) in the entirety of the member is exemplified. However, as the mesh member 65, a mesh member in which the size of the holes (coarseness) is varied between the central region 601 and both the end regions 602, 603 of the outlet 62 in the axial direction D may be used. Specifically, the mesh member 65 in which the size of the holes (coarseness) in the central region 601 of the outlet 62 is larger than the size of the holes (coarseness) in both the end regions 602, 603 of the outlet 62 is used.

With the through portion 6B (including the through portion 6 according to the first exemplary embodiment) provided with such a mesh member 65, due to the variation in size of the holes of the mesh member 65, when the air flow E1 having introduced into the through portion 6B (6) is discharged through the outlet 62, the occurrences of a situation in which the amount of the toner of the developer 15 discharged through both the end regions 602, 603 of the outlet 62 exceeds that discharged through the central region 601 of the outlet 62 may be suppressed.

In addition, although the image forming apparatus 1 that uses a single developing device 5 (5B, 5C, 5D) so as to form monochrome images is exemplified according to the first to fourth exemplary embodiments, the image forming apparatus according to the disclosure may use a plurality of developing devices 5 (5B, 5C, 5D) so as to form multi-color images.

Furthermore, the developing device 5 (5B, 5C, 5D) may be disposed and used above an inclined sheet transport path as a sheet transport path through which the sheet 9 is transported.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A developing device comprising:

a housing that includes a container portion containing developer and that has a developing opening;

a developer holding device that holds the developer in the container portion of the housing and that is rotated so as to pass the developing opening; and a directing device, wherein the developing device has a through portion disposed at a portion of the housing including a downstream edge portion at a downstream portion of the developing opening in a direction in which the developer holding device is rotated, wherein the through portion has an inlet, an outlet, and a passage that connects the inlet and the outlet to each other so as to allow part of an airflow generated by rotation of the developer holding device to be introduced thereinto and flow therethrough, wherein the directing device extends from a portion of the housing opposite to the developing opening with the inlet of the through portion interposed therebetween toward the developer holding device so as to direct the part of the airflow toward the inlet, and wherein, in an axial direction of the developer holding device, an opening area of a portion of the inlet of the through portion disposed in a central region is larger than a total of opening areas of portions of the inlet of the through portion disposed in end regions, wherein a height of the opening area of the portion of the inlet of the through portion disposed in the central region is larger than a height of the opening areas of the portions of the inlet of the through portion disposed in the end regions.

2. The developing device according to claim 1, wherein the through portion has side openings provided in respective side surfaces at ends of the passage in the axial direction, and wherein the developing device includes air supply devices that supply air from the respective side openings toward a center of the passage in the axial direction.

3. The developing device according to claim 1, wherein a dimension of the inlet in a direction intersecting the axial direction is larger than a dimension of a gap between the directing device and the developer holding device.

4. The developing device according to claim 1, wherein, in the through portion, the opening areas of the parts of the inlet disposed in the end regions increase toward the central region.

5. The developing device according to claim 1, wherein the passage of the through portion has a bottom surface portion bent toward the housing between the inlet and the outlet.

6. The developing device according to claim 1, wherein a mesh member is provided at the outlet of the through portion.

7. The developing device according to claim 1, wherein the developing device is disposed in use above a sheet transport path through which a sheet of paper is transported.

8. An image forming apparatus comprising:

an image holding device on which an electrostatic latent image is formed; and the developing device according to claim 1 that develops the electrostatic latent image on the image holding device with the developer.

9. The image forming apparatus according to claim 8, wherein the developing device is disposed above a sheet transport path through which a sheet of paper is transported.

10. A developing device comprising:

a housing that includes a container portion containing developer and that has a developing opening;

a developer holding device that holds the developer in the container portion of the housing and that is rotated so as to pass the developing opening; and a directing device, wherein the developing device has a through portion disposed at a portion of the housing including a downstream edge portion at a downstream portion of the developing opening in a direction in which the developer holding device is rotated, wherein the through portion has an inlet, an outlet, and a passage that connects the inlet and the outlet to each other so as to allow part of an airflow generated by rotation of the developer holding device to be introduced thereinto and flow therethrough, wherein the directing device extends from a portion of the housing opposite to the developing opening with the inlet of the through portion interposed therebetween toward the developer holding device so as to direct the part of the airflow toward the inlet, and wherein the through portion has side openings provided in respective side surfaces at ends of the passage in an axial direction of the developer holding device, wherein the respective side surfaces at the ends of the passage are substantially perpendicular to the axial direction of the developer holding device, and wherein the developing device includes air supply devices that supply air from the respective side openings toward a center of the passage in the axial direction.

11. The developing device according to claim 10, wherein the air supply devices supply the air such that the air moves in an oblique direction so as to approach the outlet as the air moves toward the center of the passage in the axial direction.

* * * * *